US006866024B2

(12) United States Patent
Rizzoni et al.

(10) Patent No.: US 6,866,024 B2
(45) Date of Patent: Mar. 15, 2005

(54) ENGINE CONTROL USING TORQUE ESTIMATION

(75) Inventors: Giorgio Rizzoni, Upper Arlington, OH (US); Yann Guezennec, Colombus, OH (US); Ahmed Soliman, Upper Arlington, OH (US); Byungho Lee, Columbus, OH (US)

(73) Assignee: The Ohio State University, Columbus, OH (US)

( * ) Notice: Subject to any disclaimer, the term of this patent is extended or adjusted under 35 U.S.C. 154(b) by 0 days.

(21) Appl. No.: 10/092,031

(22) Filed: Mar. 5, 2002

(65) Prior Publication Data

US 2003/0167118 A1 Sep. 4, 2003

Related U.S. Application Data

(60) Provisional application No. 60/273,423, filed on Mar. 5, 2001.

(51) Int. Cl.[7] ..... F02B 17/00

(52) U.S. Cl. ..... 123/430; 123/406.22; 123/435; 701/110; 73/116

(58) Field of Search ..... 701/110; 123/430, 123/406.22, 406.41, 435, 436; 73/116

(56) References Cited

U.S. PATENT DOCUMENTS 4,984,988 A 1/1991 Mizushina et al. ..... 434/380
5,278,760 A * 1/1994 Ribbens et al. ..... 701/111
5,771,482 A * 6/1998 Rizzoni ..... 701/101
6,223,120 B1 * 4/2001 Williams ..... 701/111
6,560,658 B2 * 5/2003 Singer et al. ..... 710/5
6,594,573 B1 * 7/2003 Rossmann et al. ..... 701/67

* cited by examiner

*Primary Examiner*—John T. Kwon
(74) *Attorney, Agent, or Firm*—Standley Law Group LLP

(57) ABSTRACT

Torque estimation techniques in the real-time basis for engine control and diagnostics applications using the measurement of crankshaft speed variation are disclosed. Two different torque estimation approaches are disclosed—"Stochastic Analysis" and "Frequency Analysis." An estimation model function consisting of three primary variables representing crankshaft dynamics such as crankshaft position, speed, and acceleration is used for each estimation approach. The torque estimation method are independent of the engine inputs (air, fuel, and spark). Both approaches have been analyzed and compared with respect to estimation accuracy and computational requirements, and feasibility for the real-time engine diagnostics and control applications. Results show that both methods permits estimations of the indicated torque based on the crankshaft speed measurement while providing not only accurate but also relatively fast estimations during the computation processes.

22 Claims, 23 Drawing Sheets

ENGINE CONTROL USING TORQUE ESTIMATION

This application claims the benefit of U.S. Provisional Patent Application No. 60/273,423 entitled ENGINE CONTROL USING TORQUE ESTIMATION and filed Mar. 5, 2001.

TECHNICAL FIELD

The present invention relates to systems and methods for engine control. In particular, the present invention relates to a system and method for engine control using stochastic and frequency analysis torque estimation techniques.

BACKGROUND AND SUMMARY OF THE INVENTION

In recent years, the increasing interest and requirements for improved engine diagnostics and control has led to the implementation of several different sensing and signal processing technologies. In order to optimize the performance and emission of an engine, detailed and specified knowledge of the combustion process inside the engine cylinder is required. In that sense, the torque generated by each combustion event in an IC engine is one of the most important variables related to the combustion process and engine performance.

In-cylinder pressure and engine torque have been recognized as fundamental performance variables in internal combustion engines for many years now. Conventionally, the in-cylinder pressure has been directly measured using in-cylinder pressure transducers in a laboratory environment. Then, the indicated torque has been calculated from the measured in-cylinder pressure based on the engine geometry while the net engine torque has been obtained considering the torque losses. However, such direct measurements using conventional pressure sensors inside engine combustion chambers are not only very expensive but also not reliable for production engines. For this reason, practical applications based on these fundamental performance variables in commercially produced vehicles have not been established yet. Therefore, instead of employing the expensive yet not reliable conventional approach, there is a need for different approaches of obtaining and using such performance variables by estimating the net cylinder torque resulting from each combustion event while utilizing pre-existing sensors and easily accessible engine state variables, such as the instantaneous angular position and velocity of the crankshaft. This approach enhances the on-board and real-time estimations of engine state variables such as instantaneous torque in each individual cylinder and bring out many possible event-based applications for electronic throttle control, cylinder deactivation control, transmission shift control, misfire detection, and general-purpose condition monitoring and diagnostics [1–3].

The crankshaft of an IC engine is subjected to complex forces and torque excitations created by the combustion process from each cylinder. These torque excitations cause the engine crankshaft to rotate at a certain angular velocity. The resulting angular speed of engine crankshaft consists of a slowly varying mean component and a quickly varying fluctuating component around the mean value, caused by the combustion events in each individual cylinder [4]. Outcome of the torque estimation approaches strongly relies on the ability to correlate the characteristics of the crankshaft angular position, speed, and its fluctuations to the characteristics of actual cylinder torque [3] and [4]. Over the past years, this torque estimation problem has been investigated by numerous researchers explicitly or implicitly, inverting an engine dynamic model of various complexities. Those researchers have successfully developed and validated the dynamic models describing the cylinder torque to the crankshaft angular velocity dynamics in internal combustion engines.

One of the earliest strategies targeted at developing the engine and crankshaft dynamic model allowing the speed-based torque estimation was carried out by Rizzoni, who introduced the possibility of accurately estimating the mean indicated torque by a two-step procedure [4]. It consists of first deconvolving the measured crankshaft angular velocity through the rotational dynamics of the engine to obtain the net engine torque which accelerates the crankshaft, and then of converting this net torque to indicated torque through a correction for the inertia torque component, caused by the reciprocating motion of crank-slider mechanism, and for piston/ring friction losses. Another strategy was introduced focusing on reconstructing the instantaneous as well as average engine torque based on the frequency-domain deconvolution method [3]. However, this method required pre-computation of the frequency response functions relating crankshaft speed to indicated torque in the frequency-domain and storing their inverses in a mapping format, which has difficulties of determining the frequency functions experimentally. An approach bypassing this difficulty was proposed by Srinivasan et al. using the repetitive estimators [5]. Further studies of the speed-based torque estimation was continued by Kao and Moskwa, and Rizzoni et al. through the use of nonlinear observers, particularly sliding mode observers [6] and [7]. This method of the nonlinear observer was desirable for variable speed applications since a wide range of operating conditions required the non-linearity of the models. Other torque estimation efforts involving an observer were based on the use of the unknown input observer by Rizzoni et al. [8–10]. This method was, however, only applicable to constant speed (or near constant speed) engines. One of the most recent research efforts aimed at the individual cylinder pressure and torque estimations was based on the stochastic approach by Guezennec and Gyan [1] and [11]. This approach permitted estimations of the instantaneous in-cylinder pressure accurately without any significant computational requirement based on the correlations between in-cylinder pressure and crankshaft speed variations.

Even though all these approaches described previously were successful over the past years, most of them were not feasible for the on-board real-time estimation and control in mass-production engines. In other words, these approaches can only be practically implemented in a post-processing phase because they must involve either highly resolved measurements of the crankshaft speed or significant amounts of computational requirements. The present invention, however, presents a practical and applicable way of implementing the speed-based torque estimation technique on a production engine in order to develop a methodology and algorithm extracting the in-cylinder pressure and indicated torque information from a less resolved/sampled crankshaft speed measurement for the purpose of real-time estimation and engine control in production vehicles. Two different approaches have been implemented, namely "Stochastic Estimation Technique" and "Frequency-Domain Analysis," to estimate the instantaneous indicated torque (as well as in-cylinder pressure) in real time based on the crankshaft speed fluctuation measurement. An overview of both techniques is presented. Next, their implementations on an in-line four-cylinder spark-ignition engine are presented under a wide range of engine operating conditions such as engine speed and load. Then, validations of the robustness of these techniques are presented through the real-time estimation of indicated torque during the actual engine operations, demonstrating that these methods have very high potential for event-based engine controls and diagnostics in mass-production engines.

DETAILED DESCRIPTION OF EXAMPLE EMBODIMENTS

Stochastic Estimation Technique

Figure 1:
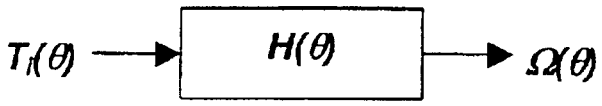
FIG. 1 is a Simplified SISO Model for Engine Dynamics for an example embodiment of the present invention.
Figure 2:
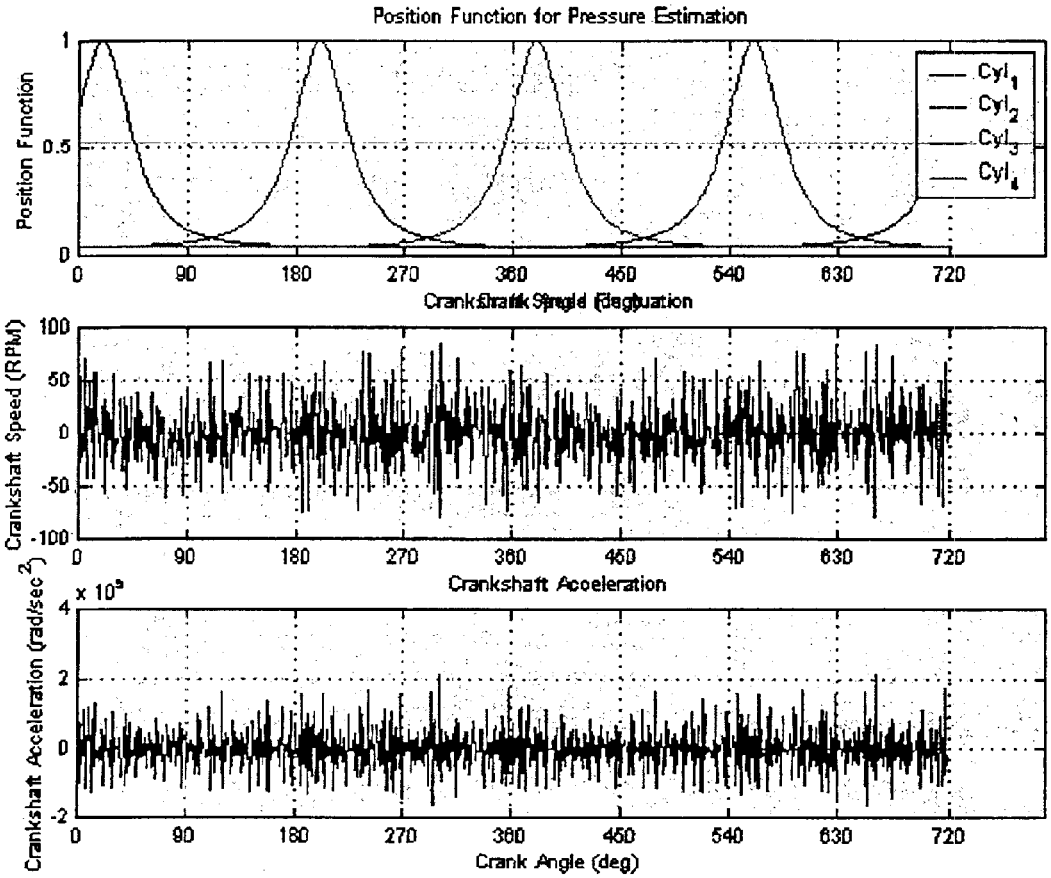
FIG. 2 shows Basis Variables for Pressure Estimation for an example embodiment of the present invention.
Figure 3:
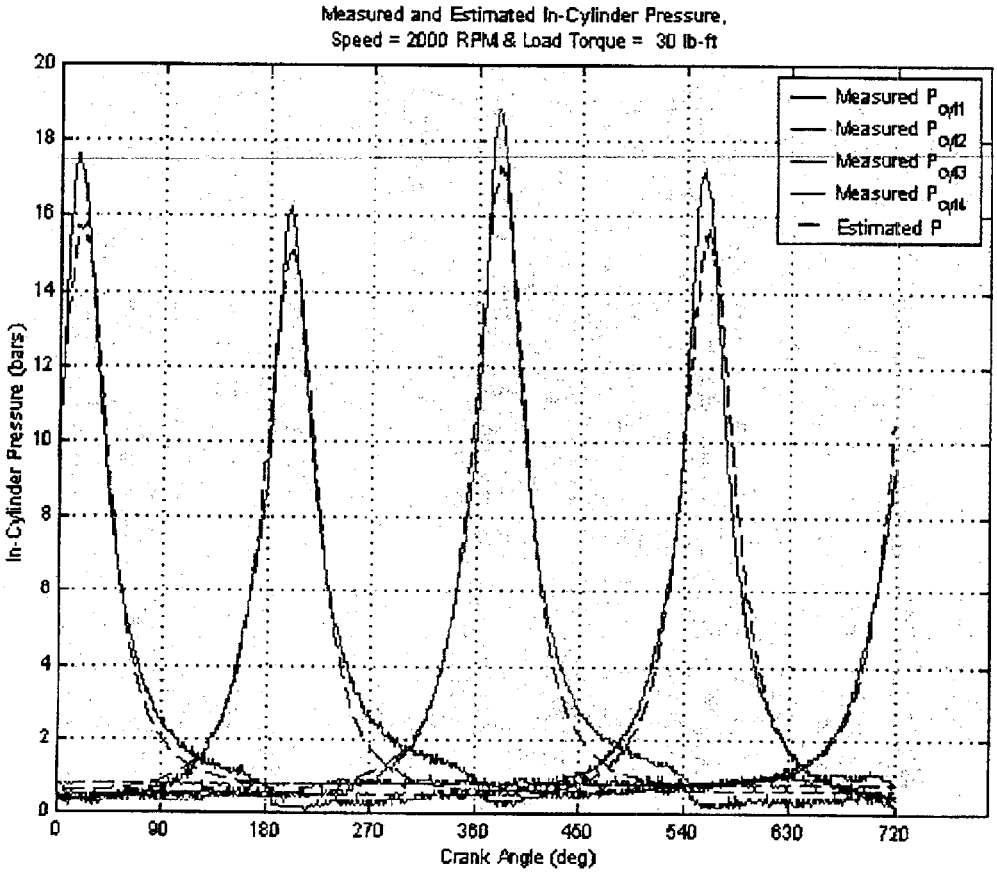
FIG. 3 shows an In-Cylinder Pressure Estimation at Speed of 2000 RPM and Load Torque of 30 $lb_f$-ft for an example embodiment of the present invention.
Figure 4:
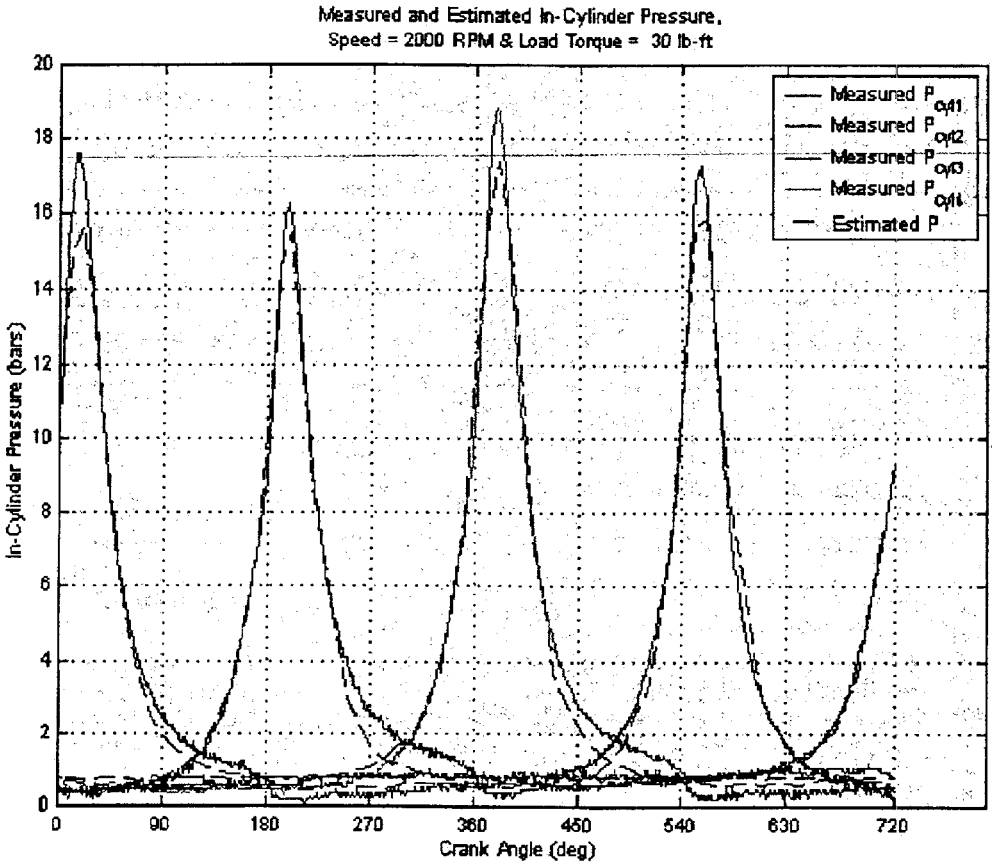
FIG. 4 shows an In-Cylinder Pressure Estimation for an example embodiment of the present invention.
Figure 5:
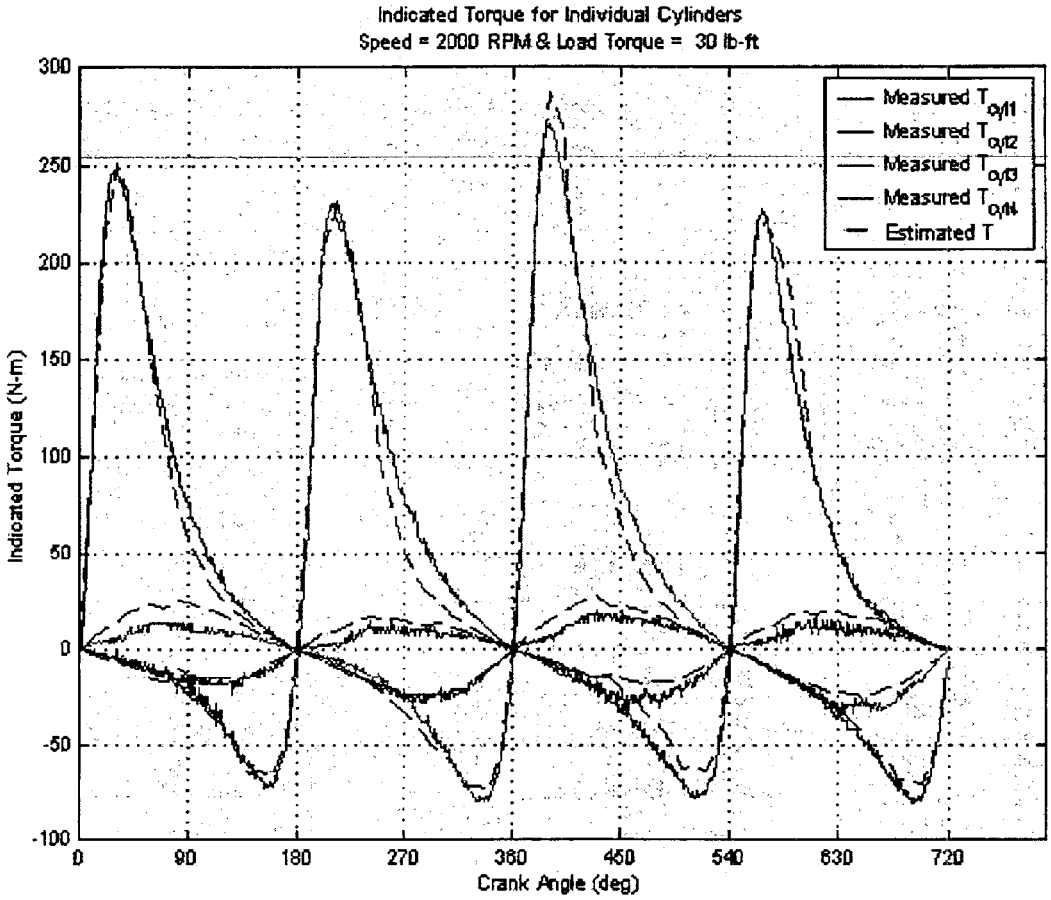
FIG. 5 shows Indicated Torque Estimation for Each Cylinder for an example embodiment of the present invention.
Figure 6:
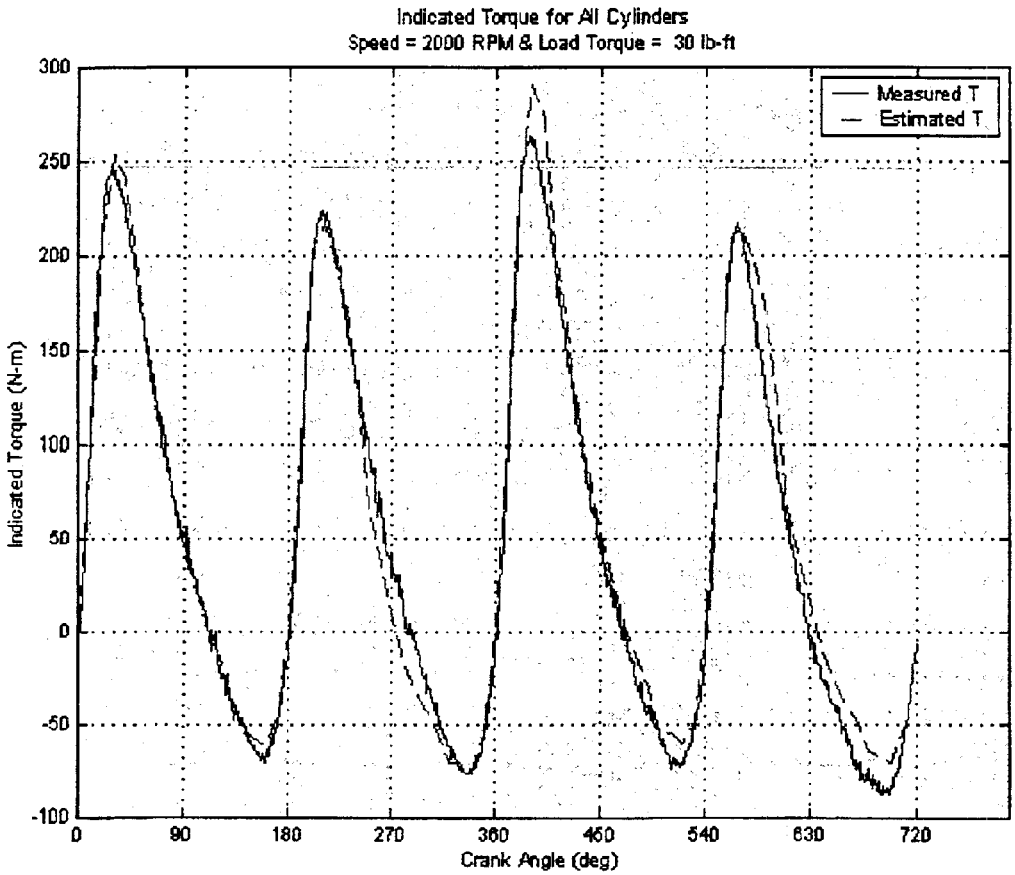
FIG. 6 shows Indicated Torque Estimation for All Cylinders for an example embodiment of the present invention.
Figure 7:
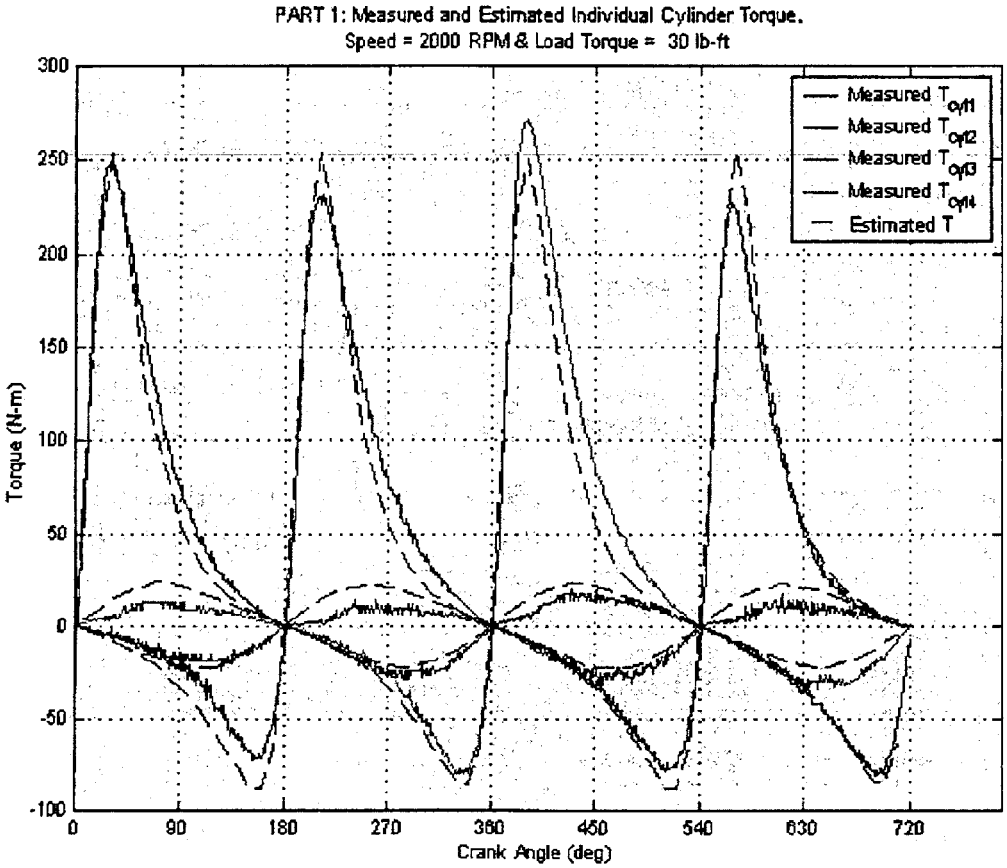
FIG. 7 shows Indicated Torque Estimation for Each Cylinder for an example embodiment of the present invention.
Figure 8:
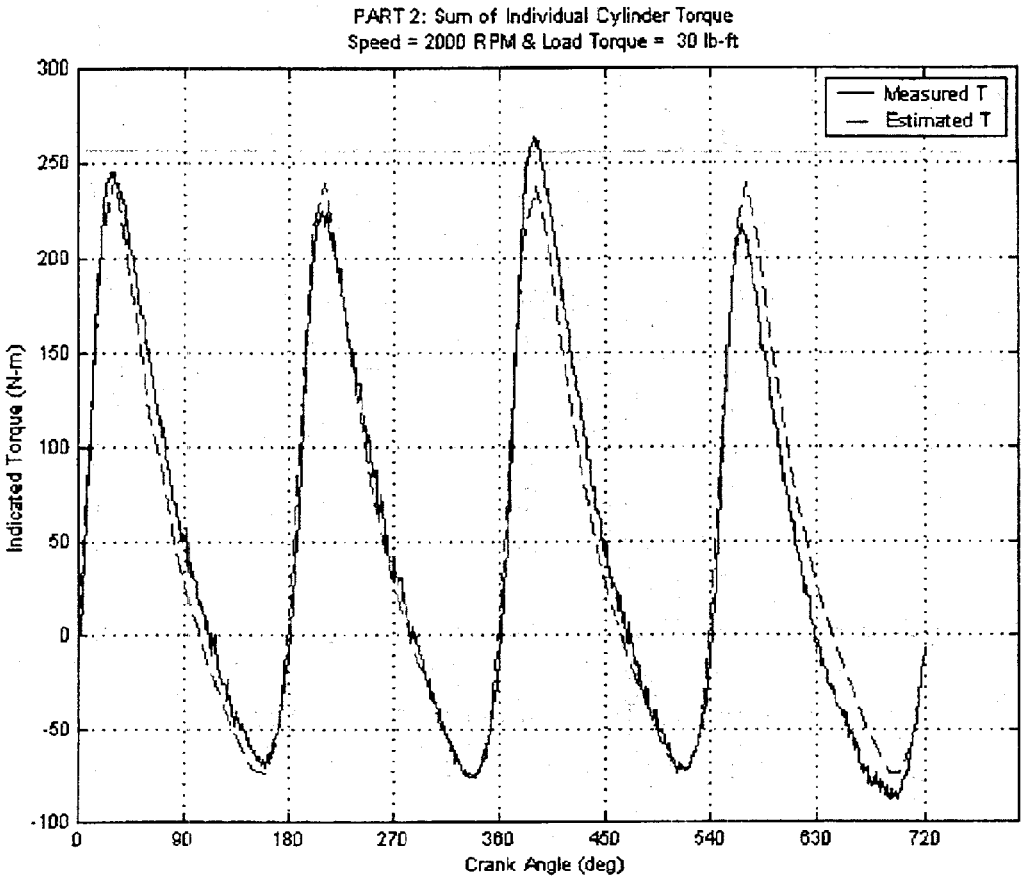
FIG. 8 shows Indicated Torque Estimation for All Cylinders for an example embodiment of the present invention.
Figure 9:
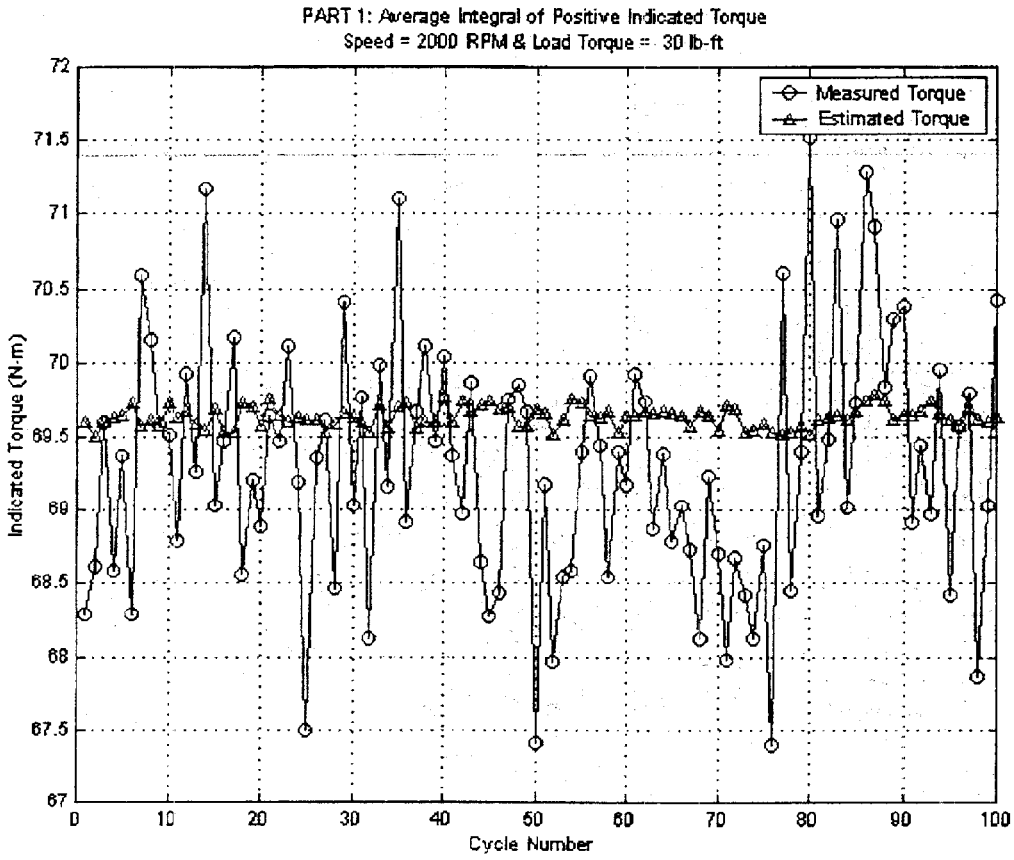
FIG. 9 shows Cycle-Averaged Indicated Torque Estimation for an example embodiment of the present invention.
Figure 10:
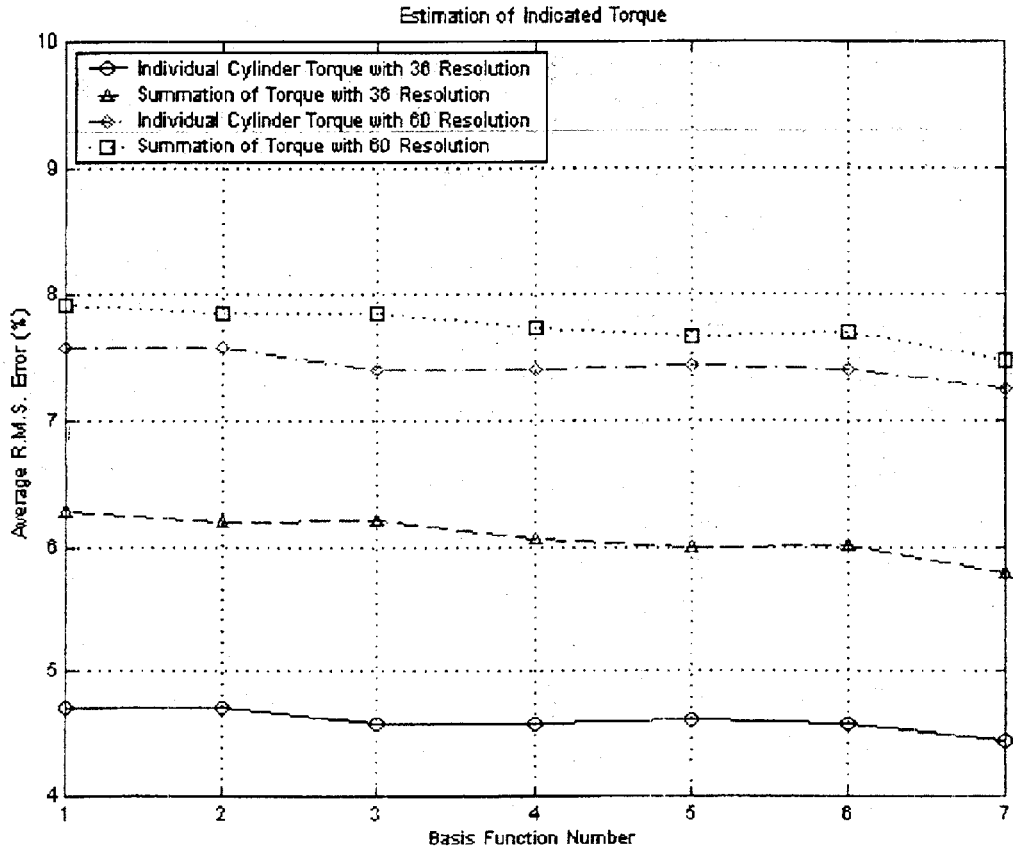
FIG. 10 shows Average R.M.S. Errors for Various Cases for an example embodiment of the present invention.
Figure 11:
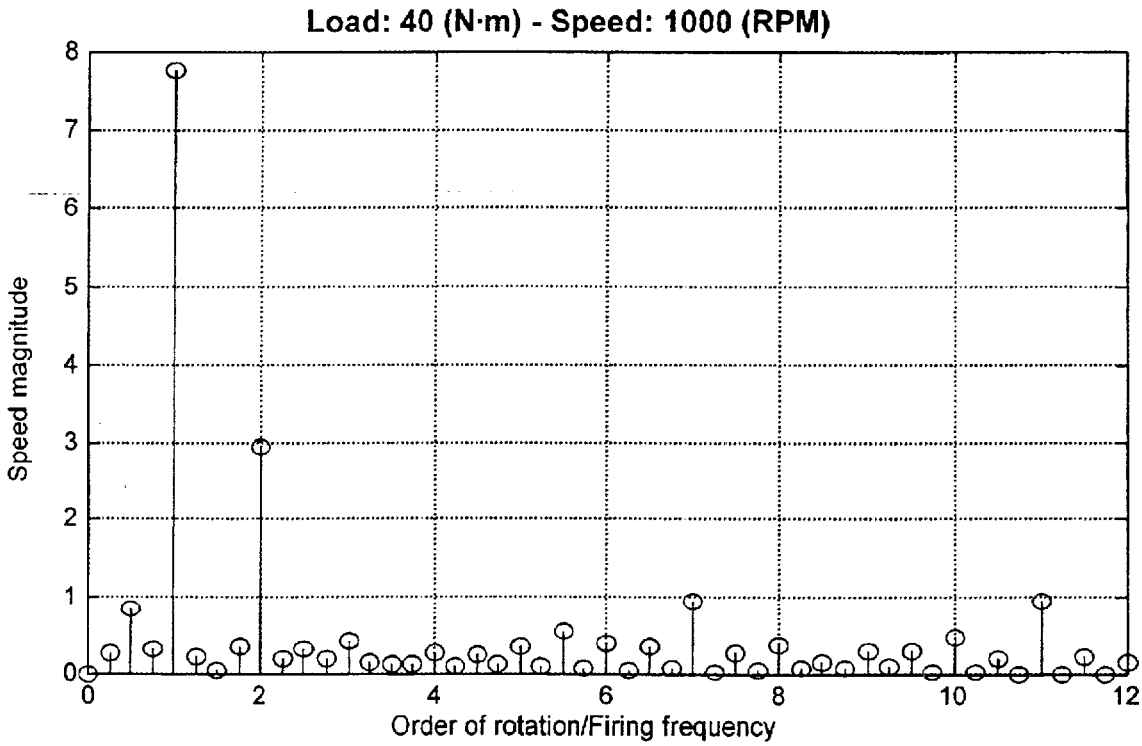
FIG. 11 shows Spatial Spectra for Indicated Torque for an example embodiment of the present invention.
Figure 12:
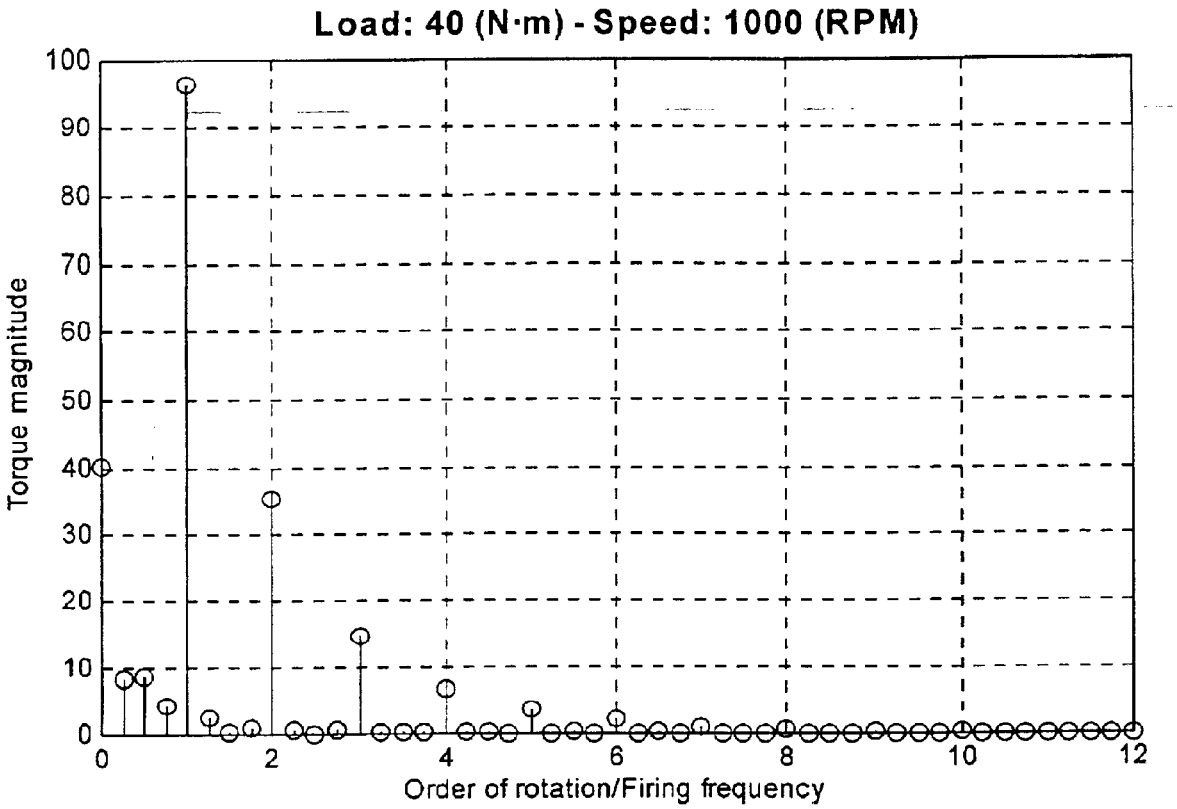
FIG. 12 shows Spatial Spectra for Speed Fluctuation for an example embodiment of the present invention.
Figure 13:
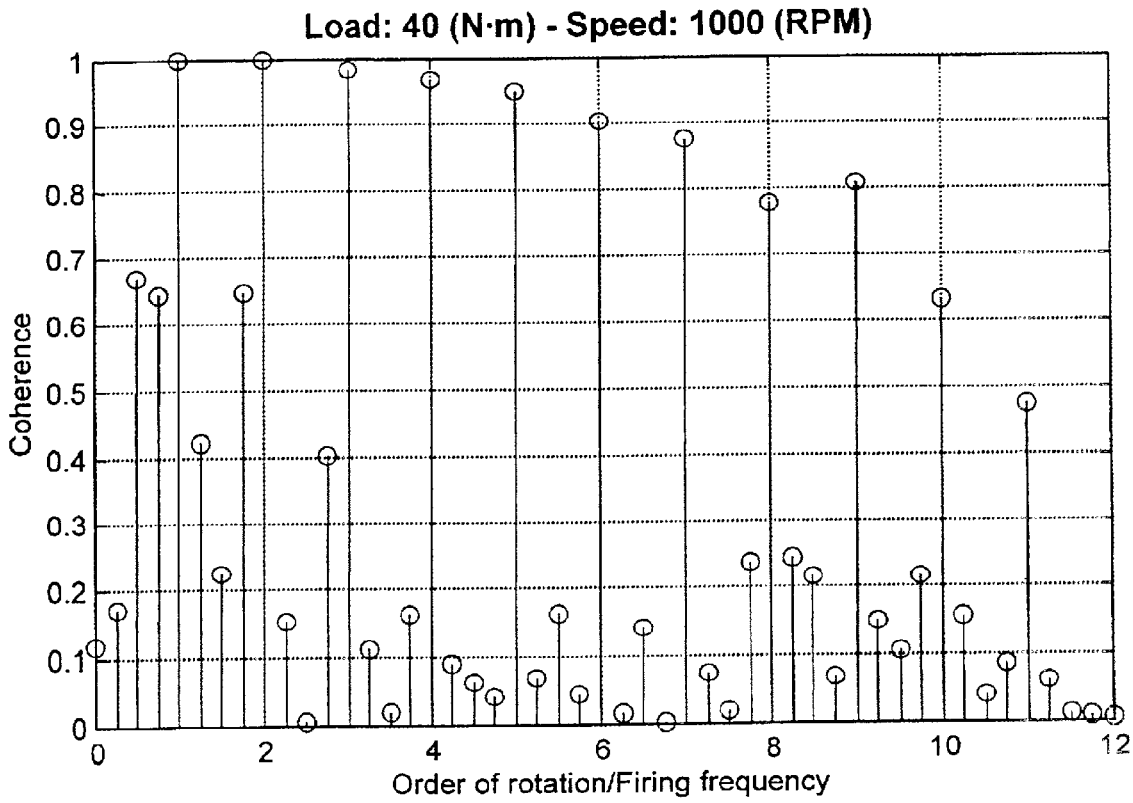
FIG. 13 shows Coherence Function for Crankshaft Speed Fluctuations and Indicated Torque for an example embodiment of the present invention.
Figure 14:
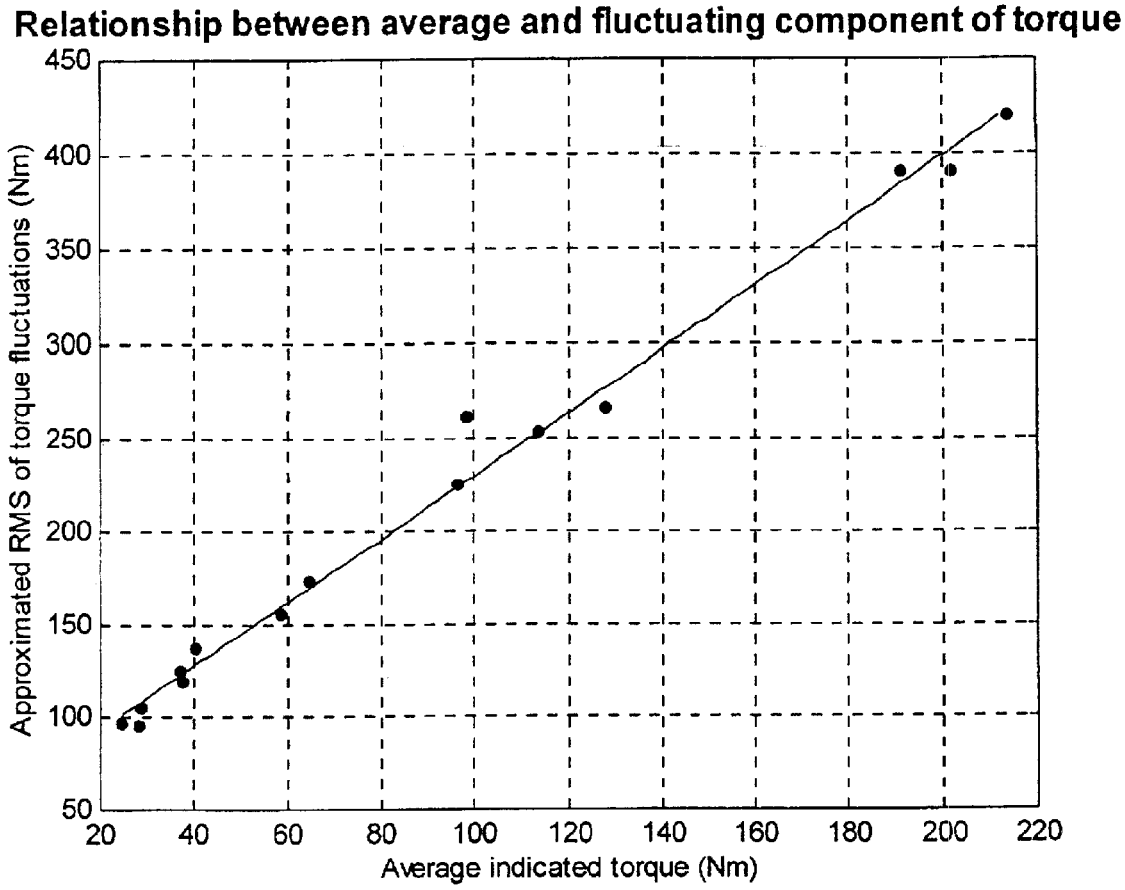
FIG. 14 shows Average Indicated Torque vs. Approximated R.M.S. of Torque Fluctuations for an example embodiment of the present invention.
Figure 15:
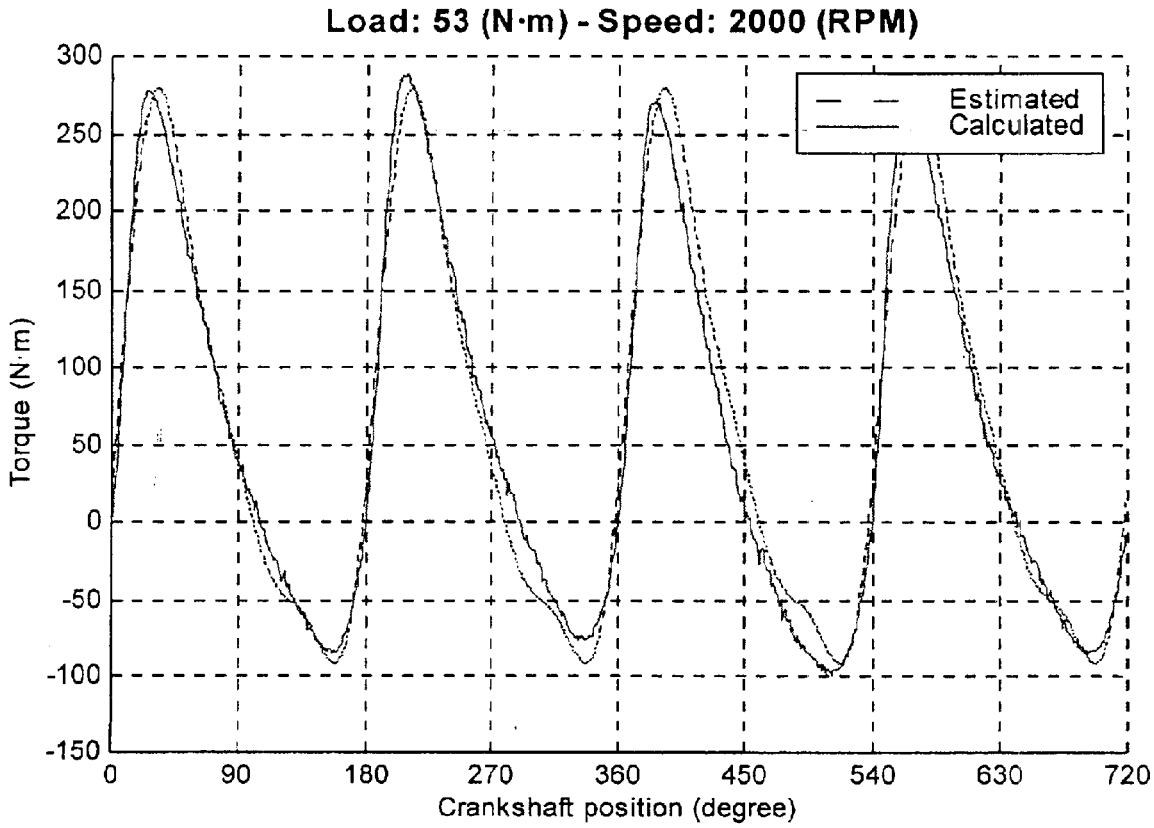
FIG. 15 shows Indicated Torque Estimation at 2000 RPM and 53 N-m Load Torque for an example embodiment of the present invention.
Figure 16:
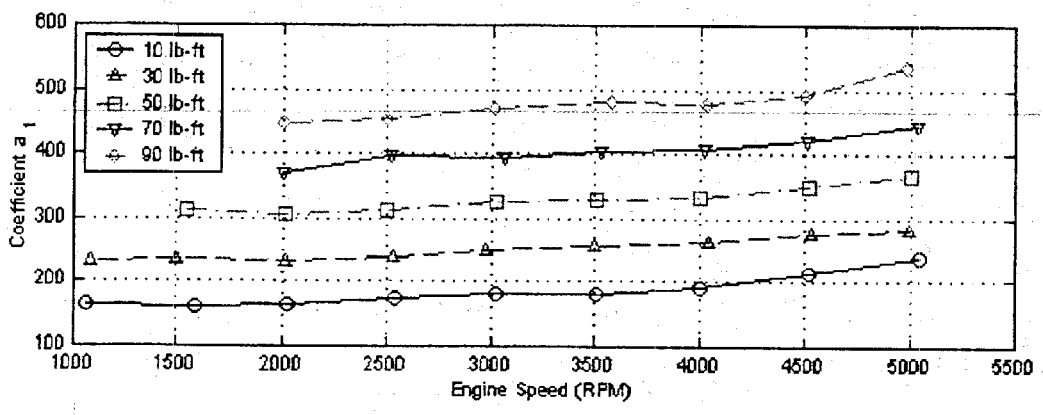
FIG. 16 shows Coefficient Estimation at All Operating Points for an example embodiment of the present invention.
Figure 16:
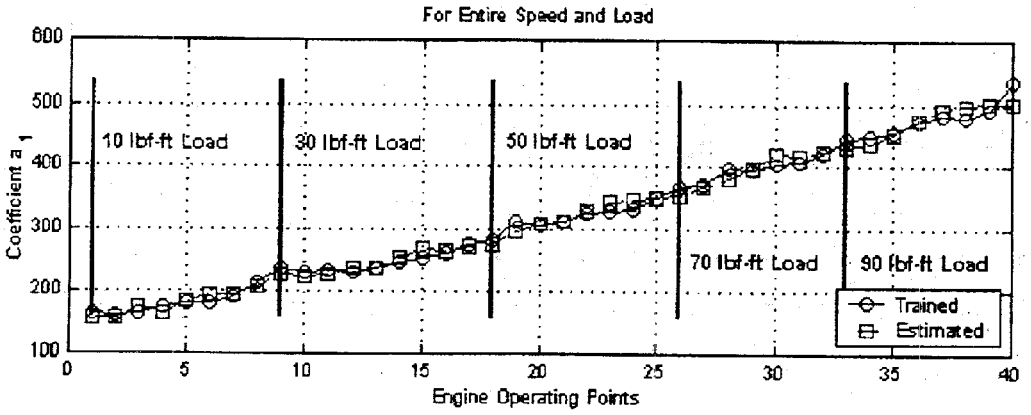
Figure 17:
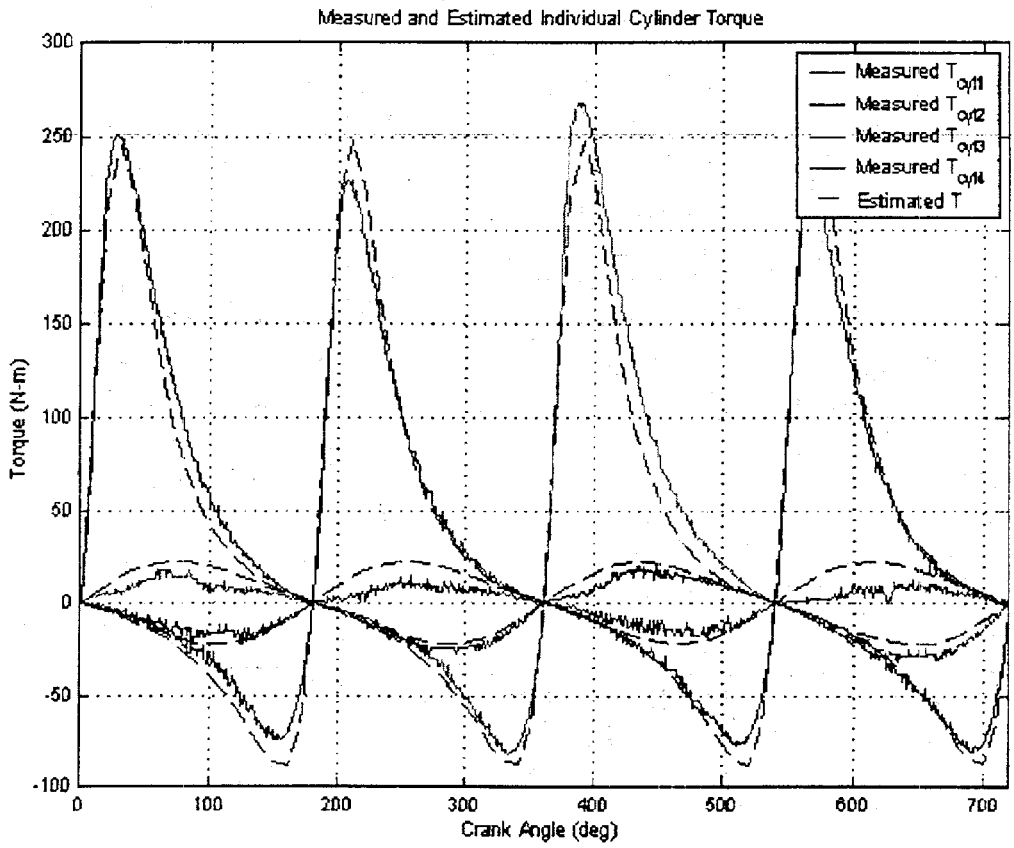
FIG. 17 shows Indicated Torque Estimation of Each Cylinder for an example embodiment of the present invention.
Figure 18:
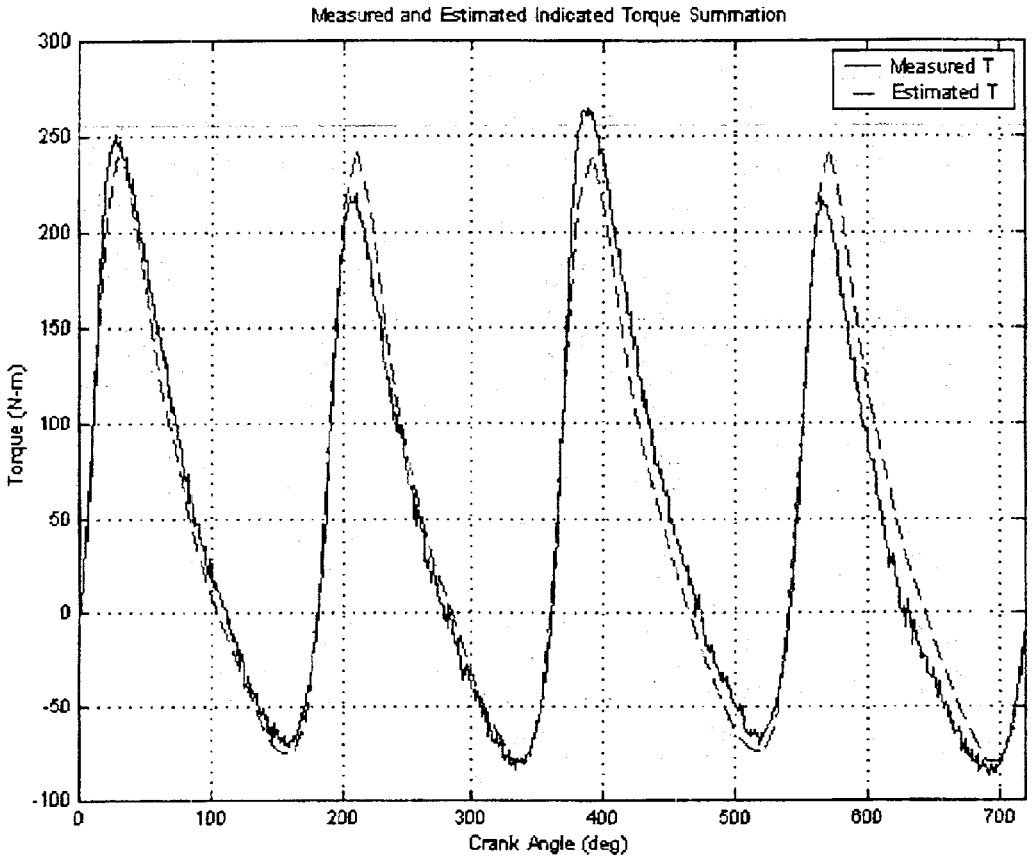
FIG. 18 shows Indicated Torque Estimation of All Cylinders for an example embodiment of the present invention.
Figure 19:
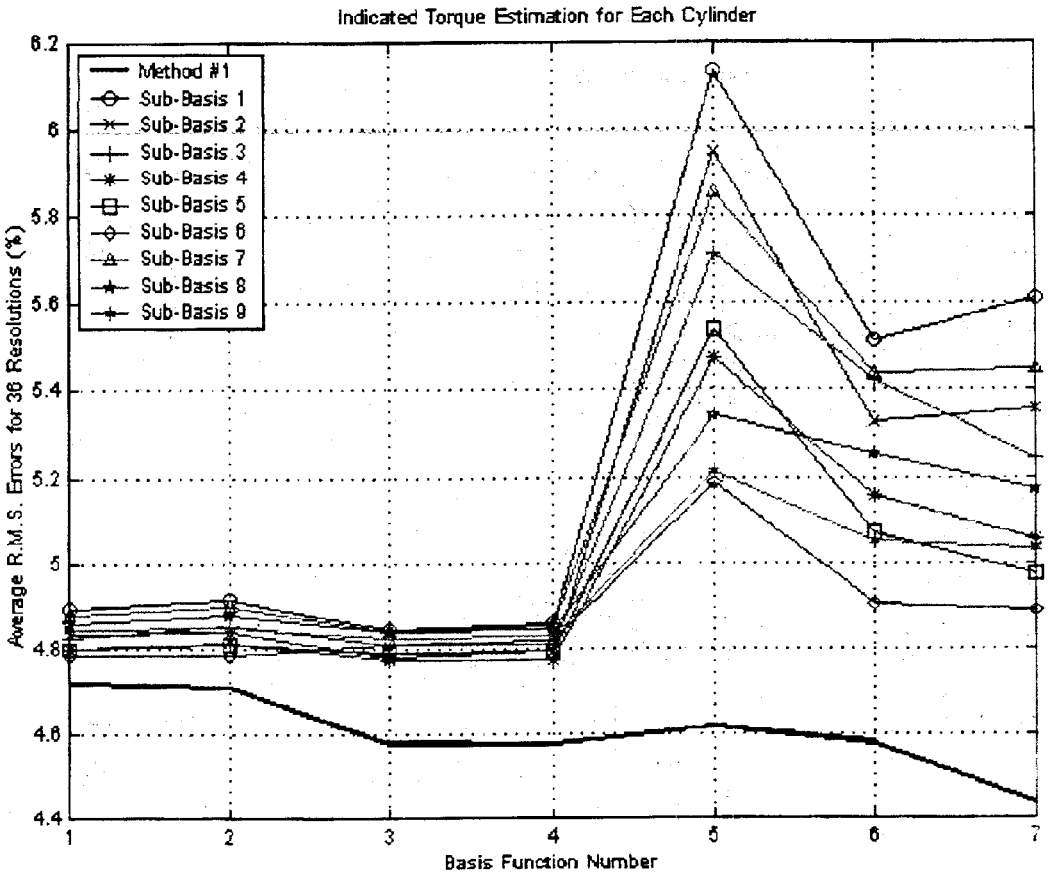
FIG. 19 shows R.M.S. Error for Various Cases for an example embodiment of the present invention.
Figure 20:
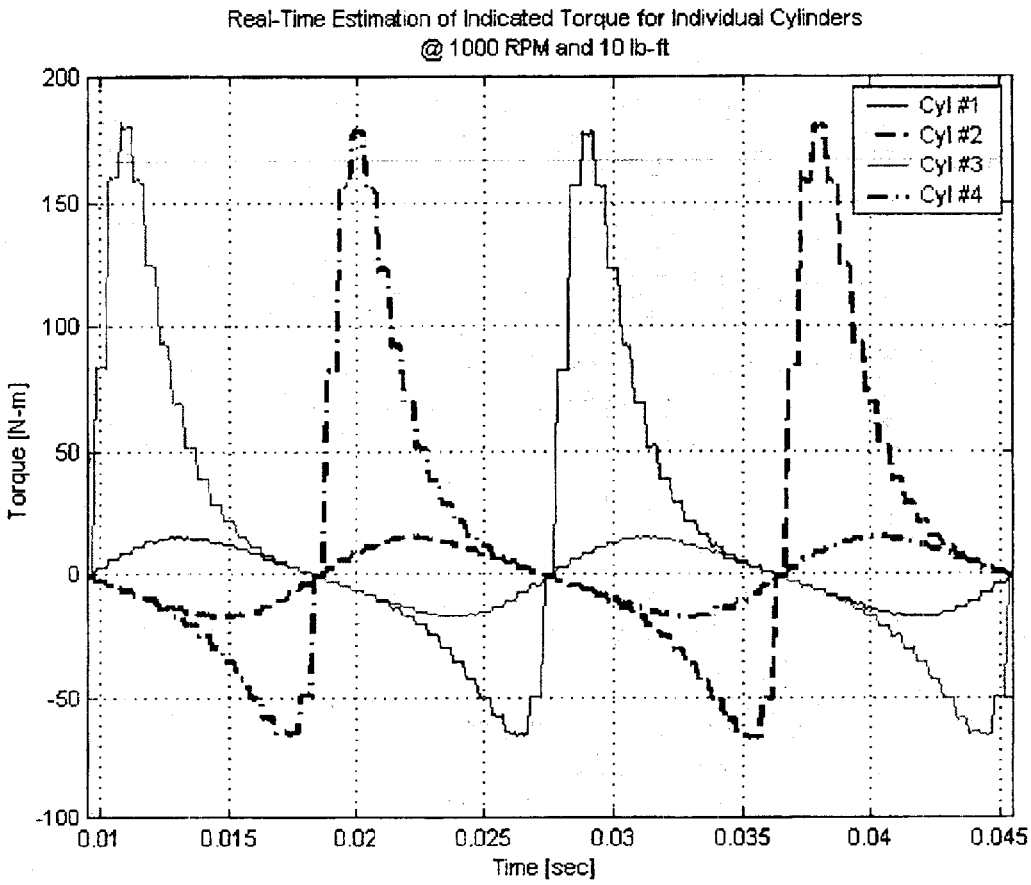
FIG. 20 shows Real-Time Estimation of Individual Cylinder Torque for an example embodiment of the present invention.
Figure 21:
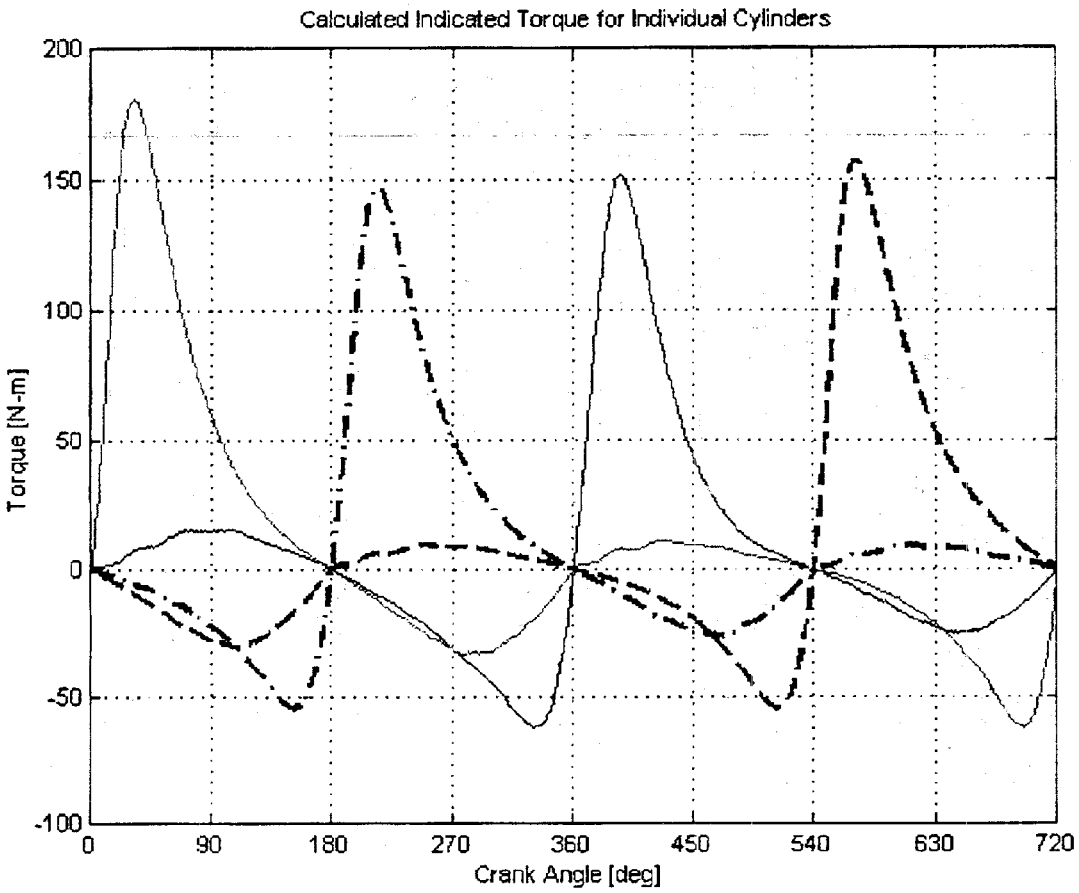
FIG. 21 shows Actual Value of Indicated Torque from Acquired Data for an example embodiment of the present invention.
Figure 22:
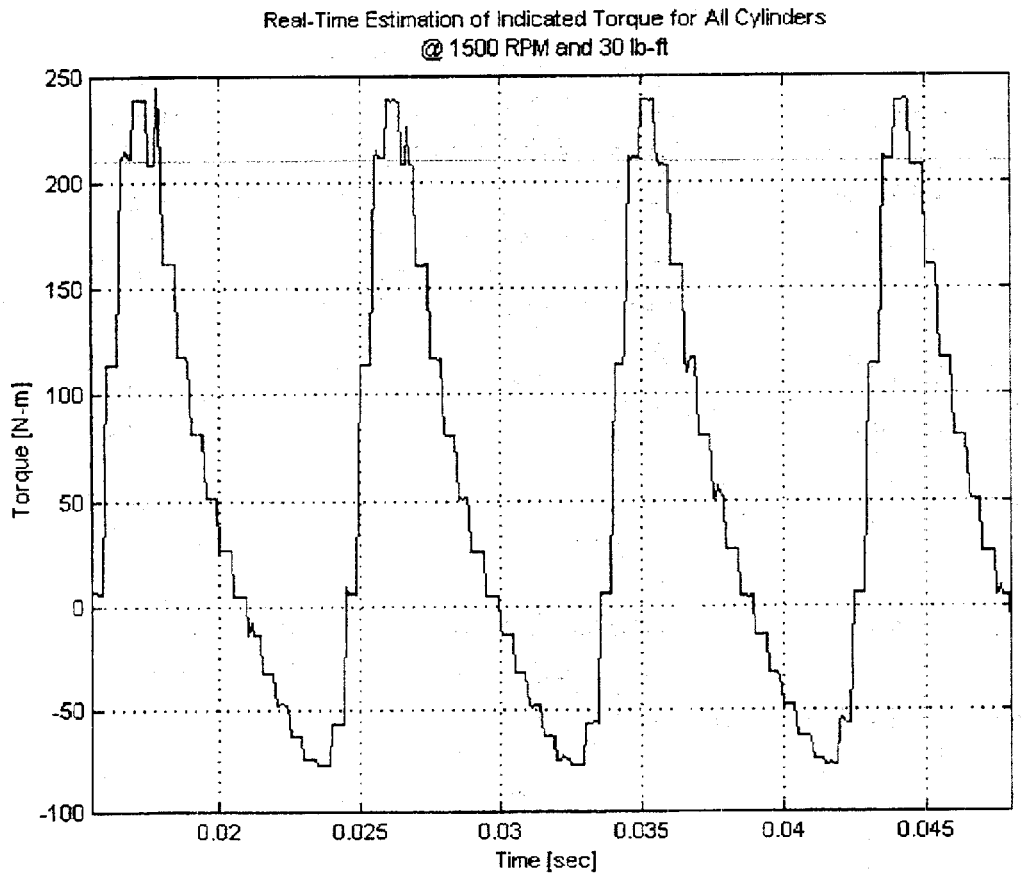
FIG. 22 shows Real-Time Estimation of Summation of Indicated Torque for an example embodiment of the present invention.
Figure 23:
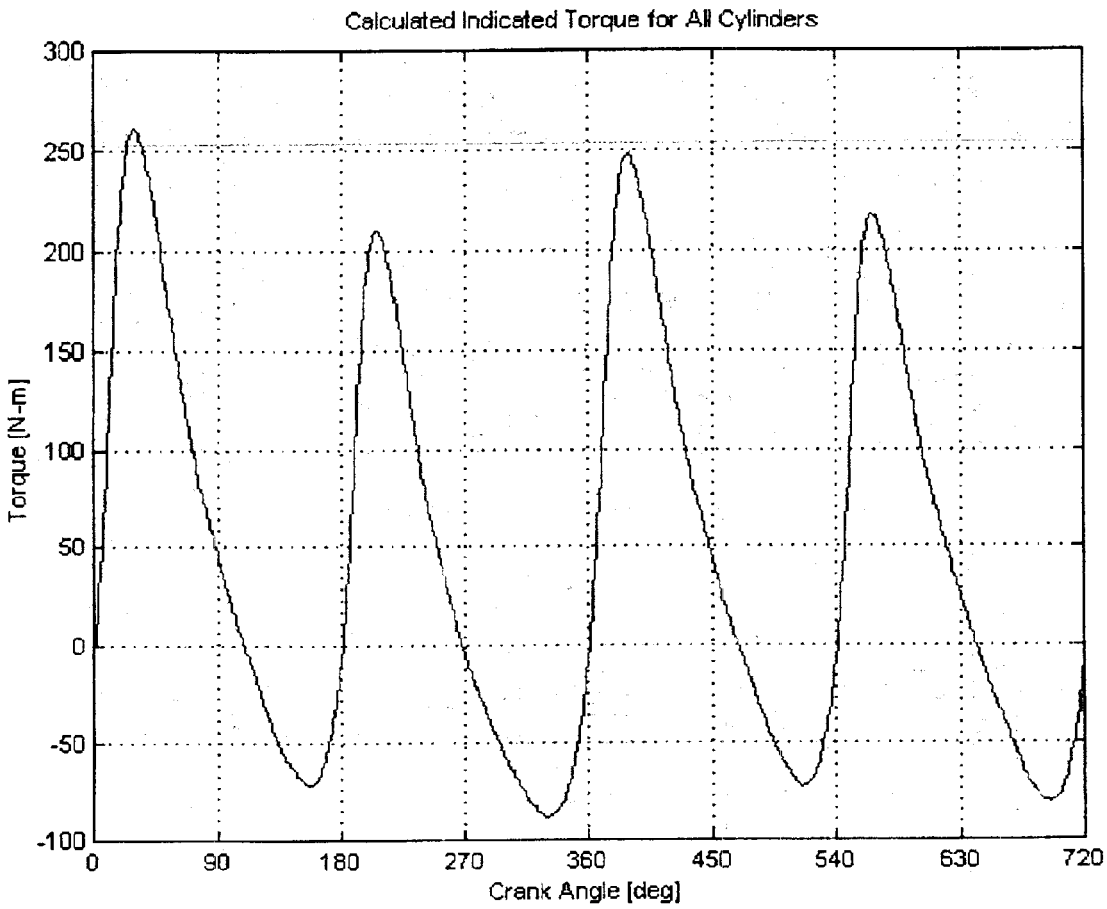
FIG. 23 show Actual Value for Sum of Indicated Torque from Acquired Data.

This technique is based on a signal processing method, herein referred to as the "Stochastic Estimation Method," which allows extraction of reliable estimates based on the method of least square fittings from a set of variables which are statistically correlated (linearly or otherwise). The procedure originates from the signal processing field, and it has been used in a variety of contexts over the past years, particularly in the field of turbulence [1]. It has been primarily used for estimating conditional averages from unconditional statistics, namely, cross-correlation functions. The main advantage of this methodology compared to others is that all complexities of the actual physical system are self-extracted from the data in the form of first, second, or higher correlation functions. Once the correlation models are determined, the estimation procedure reduces to a simple evaluation of polynomial forms based on the measurements. Consequently, the estimation can be achieved in real time with very few computational operations. The stochastic estimation methodology may be used in order to achieve the estimation of in-cylinder pressure and indicated torque based on the crankshaft speed measurements.

A given set of variables of $x_1$, $x_2$, $x_3$, and $x_4$ may be statistically correlated with another variable of y. Each variable has N number of realizations or measurements. Then, a polynomial equation to express y in terms of $x_1$ though $x_4$ can be written as $$y_{estimate}=a_0+a_1x_1+a_2x_2+a_3x_3+a_4x_4 \tag{1}$$

where $a_0$ to $a_4$ are the polynomial coefficients. Applying the least mean squares gives the expression of an error between the true value of y ($y_{true}$) and estimated value of y ($y_{estimate}$) such as $$\varepsilon=\sum_{k=1}^{N}(y_{true,k}-y_{estimate,k})^2 \tag{2}$$

where $\epsilon$ is the estimation error, and N is the total number of realizations. Then, the polynomial coefficients in Eq. (1), $a_0$ through $a_4$, must be determined so that Eq. (1) estimates the variable y as best as possible based on the statistical sample of N realizations. This best estimation corresponds to minimizing the error term $\epsilon$ over all realizations, which leads to taking the partial derivatives of the error in Eq. (2) with respect to each of the coefficients and then setting them equal to zero. This procedure results in the following set of equations.

$$a_0\Sigma 1+a_1\Sigma x_{1,k}+a_2\Sigma x_{2,k}+a_3\Sigma x_{3,k}+a_4\Sigma x_{4,k}=\Sigma y_{true,k}$$

$$a_0\Sigma x_{1,k}+a_1\Sigma x_{1,k}^2+a_{2\Sigma x1,k}x_{2,k}a_3\Sigma x_{1,k}x_{3,k}a_4\Sigma x_{1,k}x_{4,k}=\Sigma x_{1,k}y_{true,k}$$

$$a_0\Sigma x_{2,k}+a_1\Sigma x_{1,k}x_{2,k}+a_2\Sigma x_{2,k}^2+a_3\Sigma x_{2,k}x_{3,k}+a_4\Sigma x_{2,k}x_{4,k}=\Sigma x_{2k}y_{true,k}$$

$$a_0\Sigma x_{3,k}+a_1\Sigma x_{1,k}x_{3,k}+a_2\Sigma x_{2,k}x_{3,k}+a_3\Sigma x_{3,k}^2a_4\Sigma x_{4,k}x_{3,k}=\Sigma x_{3,k}y_{true,k}$$

$$a_0\Sigma x_{4,k}+a_1\Sigma x_{1,k}x_{4,k}+a_2\Sigma x_{2,k}x_{4,k}+a_3\Sigma x_{3,k}x_{4,k}+a_4\Sigma x_{4,k}^2=\Sigma x_{4,k}y_{true,k}$$

Taking an average over all realizations for each equation then converting them into a matrix form gives the following final format.

$$\begin{bmatrix} \langle 1\rangle & \langle x_1\rangle & \langle x_2\rangle & \langle x_3\rangle & \langle x_4\rangle \\ \langle x_1\rangle & \langle x_1^2\rangle & \langle x_1x_2\rangle & \langle x_1x_3\rangle & \langle x_1x_4\rangle \\ \langle x_2\rangle & \langle x_1x_2\rangle & \langle x_2^2\rangle & \langle x_2x_3\rangle & \langle x_2x_4\rangle \\ \langle x_3\rangle & \langle x_1x_3\rangle & \langle x_2x_3\rangle & \langle x_3^2\rangle & \langle x_3x_4\rangle \\ \langle x_4\rangle & \langle x_1x_4\rangle & \langle x_2x_4\rangle & \langle x_3x_4\rangle & \langle x_4^2\rangle \end{bmatrix} \begin{bmatrix} \langle a_0\rangle \\ \langle a_1\rangle \\ \langle a_2\rangle \\ \langle a_3\rangle \\ \langle a_4\rangle \end{bmatrix} = \begin{bmatrix} \langle y_{true}\rangle \\ \langle y_{true}x_1\rangle \\ \langle y_{true}x_2\rangle \\ \langle y_{true}x_3\rangle \\ \langle y_{true}x_4\rangle \end{bmatrix} \tag{3}$$

where <> denotes averaging over all realizations. After the cross-correlation matrices have been constructed based on all the available N realizations as shown in Eq. (3) above, the set of polynomial coefficients, $a_0$ through $a_4$, can be determined once for all. Then, the variable y can be estimated using Eq. (1) during the estimation phase without any significant computational requirement. For the implementations of this technique on IC engines, it is necessary to obtain quantitative representations of the in-cylinder combustion events, such as in-cylinder pressure and indicated torque, based on the given measurements of the crankshaft rotational dynamics (position, speed, and acceleration). Therefore, cross-correlation functions may be built as shown in Eqs. (1) and (3) between the quantities to estimate (in-cylinder pressure or indicated torque) and the quantities measured (or combinations of those quantities).

Frequency Analysis Technique

One of the main advantages of using the frequency domain technique is that the accuracy of the estimation can be improved by performing the operation in the frequency domain rather than in the time or crank angle domain, considering only a few frequency components of the measured crankshaft speed signals [3]. This reconstruction technique is feasible mainly due to the intrinsically periodic nature of the engine process, which leads to the use of Fourier Transform as a tool of performing the crankshaft speed deconvolution through the engine crankshaft dynamics. The computation in the frequency domain, employing the Discrete Fourier Transform, effectively acts as a comb filter on the speed signal and preserves the desired information, which is strictly synchronous with the engine firing frequency [3]. This frequency domain deconvolution is very effective mainly because it reduces the process to an algebraic operation and the dynamic model representing the rotating assembly needs to be known only at the frequencies that are harmonically related to the firing frequency [4].

In order to perform the speed-based torque estimation using the frequency approach, the engine crankshaft dynamics are considered as a SISO (Single-Input & Single-Output) model, as described in FIG. (1).

Within FIG. (1), the indicated torque (denoted by $T_i(\theta)$) is considered as an input to the engine dynamic system (denoted by $H(\theta)$), and the crankshaft speed (denoted by $\Omega(\theta)$) is considered as a system output resulting from the torque generated by the engine. Because those signals are acquired in the crank angle domain as denoted, the Fourier Transform generates the spatial spectrum. The relationship between the indicated torque and crankshaft speed in the spatial frequency domain can be described as shown in Eq. (4) below $$\tau_i(j\lambda_k)=\Omega(j\lambda_k)H^{-1}(j\lambda_k) \tag{4}$$

where j is the imaginary part, $\lambda_k$ is the angular frequency ($k^{th}$ order of rotation), $\tau_i(j\lambda_k)$ and $\Omega(j\lambda_k)$ are the Fourier Transforms for the indicated torque and crankshaft speed respectively, evaluated at a frequency of $\lambda_k$, and $H(j\lambda_k)$ is the engine frequency response function evaluated at that frequency. Therefore, the frequency response function H is obtained at each of the first few harmonics of the engine firing frequency through either experimental data or theoretical models. Then, computing the Discrete Fourier Transform of the crankshaft speed ($\Omega(j\lambda_k)$) at each of the selected harmonics allows us to evaluate the indicated torque in the frequency domain ($\tau_i(j\lambda_k)$) at each harmonic using Eq. (4). Finally, $\tau_i(j\lambda_k)$ can be converted into the crank angle domain using the Inverse Discrete Fourier Transform at each of the harmonics in order to obtain the estimation of the indicated torque. To implement this approach on IC engines in real-time, the first few harmonics of the firing frequency within the signals contain enough information to represent the actual engine behavior between the crankshaft speed and indicated torque of the simplified SISO engine dynamics model described in FIG. (1) [4].

Experimental Data

In order to validate and implement the approaches described previously, the estimation techniques were applied to a set of experimental data acquired from a 2.4L, DOHC, in-line four, spark-ignited, passenger car engine manufactured by General Motors. The main characteristics of the engine are described in Table (1) below. Results from this data set are provided. The experimental data sets consist of various measurements, listed in Table (2), with an angular resolution of 1° of crank angle (720 data points per engine cycle) and 100 consecutive engine cycles for each measurement. Each data set was acquired under a wide range of engine operating conditions for various engine speed and load, as shown in Table (3).

TABLE 1

Characteristics of Engine

| Engine Type | I-4 spark ignited, DOHC |
|---|---|
| Bore | 90 mm |
| Stroke | 94 mm |
| Connecting Rod Length | 145.5 mm |
| Displacement Volume | 2.4 liter |
| Number of Valve | 4 per cylinder |
| Compression Ratio | 9.7 |

TABLE 2

List of Measured Data

| TDC of Cylinder #1 | Intake Air Flow Rate |
|---|---|
| Each Cylinder Pressure | Load Torque |
| Crankshaft Speed | Intake Air Temperature |
| Intake Manifold Pressure | Exhaust Gas Temperature |
| Air/Fuel Ratio | Engine Oil Temperature |
| Spark Ignition Timing | Coolant Temperature |
| Fuel Injection Timing | Throttle Position |

TABLE 3

Various Engine Operating Conditions

| Load Torque [$lb_f$-ft] | Engine Speed [RPM] (With an Increment of 500 RPM) |
|---|---|
| 10 | 1000 to 5000 RPM |
| 30 | 1000 to 5000 RPM |
| 50 | 1500 to 5000 RPM |
| 70 | 2000 to 5000 RPM |
| 90 | 2000 to 5000 RPM |

Torque Estimation Using Stochastic Analysis Method

A direct application of this methodology on the speed-based torque estimation is described. There are two separate approaches to estimate the indicated torque based on the crankshaft speed fluctuations. The first approach consists of estimating the in-cylinder combustion pressure then calculating the indicated torque based on the estimated pressure and the engine geometry. The other approach consists of directly estimating the indicated torque from the crankshaft speed fluctuation measurement.

In any case of estimation approaches, the estimation model function (referred as the basis function) consists mainly of three primary variables representing the crankshaft dynamics such as crankshaft position, speed, and acceleration. A function related to the crankshaft angular position is included instead of crank angle itself in the basis function because the angular position is clearly cyclic with a period of $4\pi$ thus introduces a discontinuity at every engine cycle. Because the mathematical foundations of the stochastic technique are continuous in nature, this discontinuity leads to undesirable mathematical errors. Consequently, a function that is mathematically related to the crankshaft position but more closely related to the behaviors of in-cylinder pressure or indicated torque is more appropriate. Because the compression and expansion strokes, excluding the combustion event, can be considered as polytropic, the in-cylinder pressure roughly follows $pV^k$=constant [12]. Because the volume of a cylinder for a given engine can be easily obtained from the given engine geometry and measured crank angle, a position function $f_\theta$ can be considered to be directly proportional to $V^{-k}$ during the compression and expansion strokes, and constant elsewhere in order to represent the position of the crankshaft [1] and [11]. Such function has a high level of correlation with the measured in-cylinder pressure or with the measured indicated torque since it effectively represents the motored pressure or motored torque information. For the crankshaft speed signal, the relevant signal is the crankshaft velocity signal fluctuating around its mean value. Therefore, the general correlation function for estimating the in-cylinder pressure or indicated torque can be written as a function of the position function $f_\theta$, angular speed fluctuation $\theta$, and angular acceleration $\theta$, as shown below.

$$\text{Estimated Value}=F(f_\theta,\dot{\theta},\ddot{\theta}) \tag{5}$$

Estimation Of In-Cylinder Pressure

After the in-cylinder combustion pressure is estimated based on the crankshaft speed measurement, the indicated torque is then calculated accordingly based on the estimated in-cylinder pressure and the given engine geometry. The estimation model function (basis function) may be set to be the following first-order non-linear model as shown in Eq. (6) in order to first estimate the in-cylinder pressure.

$$P_{estimate}=a_0+a_{1f\theta}+a_2f_\theta\dot{\theta}+a_3f_\theta\dot{\theta}^2+a_4\dot{\theta}\ddot{\theta} \tag{6}$$

The stochastic estimation approach requires building the cross-correlation functions between the estimation quantity (in-cylinder pressure) and the measured quantities (three basic variables as well as their cross-terms as shown in Eq. (6)). The coefficients, $a_0$ through $a_4$, can be obtained by minimizing the mean square difference between the measured pressure and the estimated pressure as shown in Eq. (7).

$$\varepsilon=\min_{a_i}\left(\sum_{k=1}^{N}(P_{measured,k}-P_{estimate,k})^2\right) \tag{7}$$

As described earlier in Eqs. (2) and (3), taking the partial derivatives with respect to each of the coefficients and setting the result equal to zero gives the following cross-correlation matrix system to solve.

$$\begin{bmatrix} \langle 1\rangle & \langle f_\theta\rangle & \langle f_\theta\tilde{\dot{\theta}}\rangle & \langle f_\theta\ddot{\theta}\rangle & \langle\tilde{\dot{\theta}}\ddot{\theta}\rangle \\ \langle f_\theta\rangle & \langle f_\theta^2\rangle & \langle f_\theta^2\tilde{\dot{\theta}}\rangle & \langle f_\theta^2\ddot{\theta}\rangle & \langle f_\theta\tilde{\dot{\theta}}\ddot{\theta}\rangle \\ \langle f_\theta\tilde{\dot{\theta}}\rangle & \langle f_\theta^2\tilde{\dot{\theta}}\rangle & \langle f_\theta^2\tilde{\dot{\theta}}^2\rangle & \langle f_\theta^2\tilde{\dot{\theta}}\ddot{\theta}\rangle & \langle f_\theta\tilde{\dot{\theta}}^2\ddot{\theta}\rangle \\ \langle f_\theta\ddot{\theta}\rangle & \langle f_\theta^2\ddot{\theta}\rangle & \langle f_\theta^2\tilde{\dot{\theta}}\ddot{\theta}\rangle & \langle f_\theta^2\ddot{\theta}^2\rangle & \langle f_\theta\tilde{\dot{\theta}}\ddot{\theta}^2\rangle \\ \langle\tilde{\dot{\theta}}\ddot{\theta}\rangle & \langle f_\theta\tilde{\dot{\theta}}\ddot{\theta}\rangle & \langle f_\theta\tilde{\dot{\theta}}^2\ddot{\theta}\rangle & \langle f_\theta\tilde{\dot{\theta}}\ddot{\theta}^2\rangle & \langle\tilde{\dot{\theta}}\ddot{\theta}^2\rangle \end{bmatrix}\begin{bmatrix} a_0 \\ a_1 \\ a_2 \\ a_3 \\ a_4 \end{bmatrix}=\begin{bmatrix} \langle P\rangle \\ \langle Pf_\theta\rangle \\ \langle Pf_\theta\tilde{\dot{\theta}}\rangle \\ \langle Pf_\theta\ddot{\theta}\rangle \\ \langle P\tilde{\dot{\theta}}\ddot{\theta}\rangle \end{bmatrix} \tag{8}$$

In Eq. (8), the various terms in the matrix represent the cross-correlations among the measured basis variables while the right side of the equation represents the cross-correlations between the measured in-cylinder pressure and the measured basis variables. These non-linear cross-correlations are pre-computed based on all available data at a certain engine operating condition, then the five coefficients are computed once for all (cycles and cylinders) at that operating point. Once the coefficients as well as these correlation functions are determined and proper processing has been carried out, the estimation procedure reduces down to the simple evaluation of a multivariate polynomial form based on the measurements. Therefore, during the estimation phase the instantaneous value of the five measured basis variables are used to evaluate the simple polynomial equation as shown in Eq. (6) for the desired estimation. Therefore, the computational requirements can become very minimal in this approach, and the estimation can be achieved in real time with a few computational operations.

Referring to FIG. (2), FIG. (2) represents each of the prescribed basis variables including the in-cylinder combustion pressure position function $f_\theta$. Based on these variables, the in-cylinder pressure was estimated using the basis function described in Eq. (6) and the cross-correlation described in Eq. (8). Referring to FIG. (3), FIG. (3) represents the estimated in-cylinder pressure trace in comparison with the measured trace at a certain engine operating point.

Referring to FIG. (3), the in-cylinder pressure estimation closely follows the actually measured pressure trace for each of the cylinders with only minor errors. Based on the estimated pressure and the given engine geometry shown in Table (1), the individual cylinder indicated torque and summation of the individual cylinder torque can be calculated as well [12].

However, this estimation is based on the resolution of 360 per crankshaft rotation (every 1° of crank angle), which would require a substantial computation power for the real-time estimation purpose. For this reason, using fewer resolved measurements, such as 36 and 60 resolutions, may allow this technique to be feasible for the real-time estimation and control application. FIG. (3) represents the in-cylinder pressure estimation based on the 36 resolutions (every 10° of crank angle).

Referring to FIG. (4), using fewer sampled measurements during the computation can also provide a successful in-cylinder pressure estimation just as using the full 360 resolutions can. Based on this pressure estimation and the given engine geometry, the individual cylinder indicated torque and summation of the individual cylinder torque were calculated and are shown in FIGS. (5) and (6), respectively.

In order to compare the estimation accuracy of different resolutions and possibly different estimation models in the later analysis, an error function was defined as the root mean square (R.M.S.) error between the measured pressure and estimated pressure. Then, this R.M.S. error was normalized by the peak pressure averaged over all cylinders and cycles, as shown in Eq. (9) below.

$$\text{Normalized R.M.S. Error} = \frac{\left\langle \sqrt{\frac{1}{N}\sum_{i=1}^{N}(p_{est,i} - p_{meas,i})^2} \right\rangle}{\langle p_{max} \rangle} \tag{9}$$

Table (4) illustrates this estimation error for each of the estimations and number of resolutions accounted in the computation. Note that the values are averages over all engine operating conditions.

TABLE 4

Normalized R.M.S. Errors for Various Cases

| Estimation Type | | Number of Resolutions 360 | 60 | 36 |
|---|---|---|---|---|
| Indicated Pressure | | 2.694% | 5.063% | 3.494% |
| Indicated Torque | Individual Cylinder | 3.394% | 5.810% | 4.313% |
| | All Cylinder | 6.159% | 7.603% | 6.814% |

Estimation of Indicated Torque

The indicated torque is estimated directly from the crankshaft speed measurements, replacing the two steps procedure of first estimating the in-cylinder pressure and secondly calculating the indicated torque accordingly. There are two different parts of achieving the indicated torque estimation in this approach. The first part is to estimate the individual cylinder torque for each cylinder then calculate their summations whereas the other part is to directly estimate the summation of individual cylinder torque.

Basis Function Selection—Various basis functions are investigated in order to determine the best form of the estimation model for the indicated torque estimation in real-time.

TABLE 5

Various Basis Functions

| Function Number | Basis Function |
|---|---|
| 1 | $T_{estimate} = a_0 + a_1 f_\theta + a_2\tilde{\dot{\theta}} + a_3\ddot{\theta}$ |
| 2 | $T_{estimate} = a_0 + a_1 f_\theta + a_2\tilde{\dot{\theta}} + a_3\ddot{\theta} + a_4\tilde{\dot{\theta}}^2$ |
| 3 | $T_{estimate} = a_0 + a_1 f_\theta + a_2 f_\theta\tilde{\dot{\theta}} + a_3 f_\theta\ddot{\theta} + a_4\tilde{\dot{\theta}}\ddot{\theta}$ |
| 4 | $T_{estimate} = a_0 + a_1 f_\theta + a_2 f_\theta\tilde{\dot{\theta}} + a_3 f_\theta\ddot{\theta} + a_4 f_\theta\tilde{\dot{\theta}} + a_5 f_\theta\ddot{\theta} + a_6\tilde{\dot{\theta}}\ddot{\theta}$ |
| 5 | $T_{estimate} = a_0 + a_1 f_\theta + a_2\tilde{\dot{\theta}} + a_3\ddot{\theta} + a_4 f_\theta^2 + a_5 f_\theta\tilde{\dot{\theta}}^2 + a_6\ddot{\theta}^2$ |
| 6 | $T_{estimate} = a_0 + a_1 f_\theta + a_2 f_\theta\tilde{\dot{\theta}} + a_3 f_\theta\ddot{\theta} + a_4\tilde{\dot{\theta}}^2 + a_5\tilde{\dot{\theta}}\ddot{\theta} + a_6\ddot{\theta}^2$ |
| 7 | $T_{estimate} = a_0 + a_1 f_\theta + a_2\tilde{\dot{\theta}} + a_3\ddot{\theta} + a_4 f_\theta^2 + a_5 f_\theta\tilde{\dot{\theta}} + a_6 f_\theta\ddot{\theta} + a_7\tilde{\dot{\theta}}^2 + a_8\tilde{\dot{\theta}}\ddot{\theta} + a_9\ddot{\theta}^2$ |

Considering the estimation accuracy, number of terms, equation order, variable selection, etc., several different forms of basis functions were investigated using the different resolutions (36, 60, and 360) and all engine operating conditions. Table (5) describes each of the basis functions selected from many basis functions that were examined.

Note here that the position function $f_\theta$ for estimating the indicated torque is different from the previous one used for the in-cylinder pressure estimation. It is effectively a normalized motored torque, which can be calculated from the given engine geometry, for each individual cylinder as well as summation of all cylinders.

Coefficient Training—After selecting one of the prescribed basis functions in Table (5), the polynomial coefficients were obtained by taking the same procedures, as described in Eqs. (7) and (8). Then, the instantaneous value of the measured basis variables or their combinations were used to evaluate each of the polynomial equations shown in Table (5) to estimated the desired indicated torque. For instance, choosing the basis function 3 would result in the following cross-correlation matrix system.

$$\begin{bmatrix} \langle 1\rangle & \langle f_\theta\rangle & \langle f_\theta\tilde{\dot{\theta}}\rangle & \langle f_\theta\ddot{\theta}\rangle & \langle\tilde{\dot{\theta}}\ddot{\theta}\rangle \\ \langle f_\theta\rangle & \langle f_\theta^2\rangle & \langle f_\theta^2\tilde{\dot{\theta}}\rangle & \langle f_\theta^2\ddot{\theta}\rangle & \langle f_\theta\tilde{\dot{\theta}}\ddot{\theta}\rangle \\ \langle f_\theta\tilde{\dot{\theta}}\rangle & \langle f_\theta^2\tilde{\dot{\theta}}\rangle & \langle f_\theta^2\tilde{\dot{\theta}}^2\rangle & \langle f_\theta^2\tilde{\dot{\theta}}\ddot{\theta}\rangle & \langle f_\theta\tilde{\dot{\theta}}^2\ddot{\theta}\rangle \\ \langle f_\theta\ddot{\theta}\rangle & \langle f_\theta^2\ddot{\theta}\rangle & \langle f_\theta^2\tilde{\dot{\theta}}\ddot{\theta}\rangle & \langle f_\theta^2\ddot{\theta}^2\rangle & \langle f_\theta\tilde{\dot{\theta}}\ddot{\theta}^2\rangle \\ \langle\tilde{\dot{\theta}}\ddot{\theta}\rangle & \langle f_\theta\tilde{\dot{\theta}}\ddot{\theta}\rangle & \langle f_\theta\tilde{\dot{\theta}}^2\ddot{\theta}\rangle & \langle f_\theta\tilde{\dot{\theta}}\ddot{\theta}^2\rangle & \langle\tilde{\dot{\theta}}\ddot{\theta}^2\rangle \end{bmatrix} \begin{bmatrix} a_0 \\ a_1 \\ a_2 \\ a_3 \\ a_4 \end{bmatrix} = \begin{bmatrix} \langle T\rangle \\ \langle Tf_\theta\rangle \\ \langle Tf_\theta\tilde{\dot{\theta}}\rangle \\ \langle Tf_\theta\ddot{\theta}\rangle \\ \langle T\tilde{\dot{\theta}}\ddot{\theta}\rangle \end{bmatrix} \tag{10}$$

The coefficient set in each basis function was computed once for all at each engine operating condition for different number of measurement resolutions. FIGS. (7) and (8) represent the estimated indicated torque in comparison with the measured indicated torque using the basis function 3 and 36 samplings per crankshaft rotation at a certain engine operating point.

Referring to FIGS. (7) and (8), the indicated torque estimations, either for individual cylinder or summation of all cylinders, also provide good agreements with the calculated indicated torque traces even based on 36 measurement resolutions.

FIG. (9) represents the estimated indicated torque along with the calculated values averaged over each engine cycle, which provides another indication of an accurate estimation result using the stochastic approach. The same procedure was then applied to 60 resolutions and the other cases of basis functions, and their R.M.S. errors are plotted in FIG. (10). Note that the errors indicate the average R.M.S. errors over all available engine operating conditions.

Torque Estimation using Frequency Analysis Method

The goal of this method is to show how crankshaft velocity fluctuations can be used to estimate the indicated torque produced by the engine. As explained previously, processes involved in generation of the torque are strictly periodic if considered in the crankshaft angle domain. The periodicity of the processes suggests the use of Fourier Transform as a tool to perform the speed deconvolution through the engine-crankshaft dynamics. Again, the approach for the present invention is based on the simultaneous measurement of crankshaft speed and indicated pressure in the crank angle domain, and on the classical method of frequency identification (experimental transfer function). Based on the SISO model previously described in FIG. (1) and Eq. (4), the spatial spectra for the indicated torque and crankshaft speed fluctuations can be constructed as shown in FIGS. (11) and (12). The first few harmonics of the engine firing frequency for these two signals contain enough information in order to represent the actual engine behavior, as the firing frequency being defined by the following equation where N is the number of cylinder, and S is the stroke.

$$\lambda_f = \frac{N*2}{S} \tag{11}$$

The easiest way to evaluate H(jλ) at each frequency is to calculate the ratio between the DFT (Discrete Fourier Transform) of $T_e(j\lambda)$ and $\Omega(j\lambda)$. Instead, a more accurate approach takes the measurement noise into account and gives the estimation of frequency response of a system using the classical frequency domain estimation technique for a SISO system. Using the notation proposed by Bendat and Piersol results the following.

Lower bound for the true frequency response:

$$H_1 = \frac{G_{T\Omega}}{G_{TT}} \tag{12}$$

Upper bound for the true frequency response:

$$H_2 = \frac{G_{\Omega\Omega}}{G_{T\Omega}} \tag{13}$$

where $G_{TT}$ and $G_{\Omega\Omega}$ are the auto-power spectral densities of indicated torque and crankshaft speed while $G_{T\Omega}$ is the cross-power spectral density between these two signals. These quantities are defined as follows:

Indicated torque auto-power spectral density:

$$G_{TT}(\lambda) = \frac{1}{M}\sum_{i=1}^{M}|T_i^{(i)}(\lambda)| \tag{14}$$

Crankshaft speed auto-power spectral density:

$$G_{\Omega\Omega}(\lambda) = \frac{1}{M}\sum_{i=1}^{M}|\Omega_i^{(i)}(\lambda)| \tag{15}$$

Speed-torque cross-power spectral density:

$$G_{T\Omega}(\lambda) = \frac{1}{M}\sum_{i=1}^{M}T_i^{(i)}(\lambda)\cdot\Omega^{(i)}(\lambda) \tag{16}$$

To obtain a better estimate of the frequency response the arithmetic average of $H_1$ and $H_2$ has been used such that, Arithmetic average of $H_1$ and $H_2$:

$$H_3 = \frac{H_1 + H_2}{2} \tag{17}$$

The first few harmonics of the engine firing frequency are sufficient to describe the engine behavior. Another reason to use only those components within the entire spectra results immediately observing the coherence function between the angular velocity fluctuations and indicated torque. Coherence is defined as the following:

Coherence function:

$$\gamma_{T\Omega}^2(\lambda) = \frac{|G_{T\Omega}(\lambda)|^2}{G_{TT}(\lambda)\cdot G_{\Omega\Omega}(\lambda)} \tag{18}$$

-continued $$0 \le \gamma_{T\Omega}^2(\lambda) \le 1 \tag{19}$$

Because the coherence function gives a measure of how input and output of a system are related at a given frequency, it is appropriate to use those frequencies in which the coherence is close to one in order to avoid errors due to acquisition noise. FIG. (13) gives an example of coherence function between indicated torque and crankshaft speed fluctuations, and confirms that it is appropriate to use only the first few harmonics of engine firing frequency to represent the examined process. Substituting values of the crankshaft speed DFT, $\Omega(j\lambda)$, and frequency response, $H_3(j\lambda)$, in Eq.(4) makes it possible to obtain an estimation of indicated torque. However, this calculation does not provide enough information on the average component of the torque. Nevertheless, it is possible to extract information on the average torque from its fluctuating portion.

Fourier analysis has shown that the first few harmonics of the engine firing frequency can fully describe the fluctuating behavior of the indicated torque as shown in FIGS. (11) and (12). Experimental results also show that a relationship exists between this fluctuating component and the average one. In practice, each variable capable of converting the torque fluctuations as a constant is a candidate to represent this relationship. In this study, the value used for this purpose is an estimate of R.M.S., obtained from the following relation, $$T_{RMSapprox} = \frac{1}{\sqrt{2}}\sum_{n=1}^{M}T(j\lambda_n) \tag{20}$$

where M is the number of harmonics taken into the account. Particularly for the average purpose, the first harmonic is considered in the estimation of the average torque as shown in the following equation.

$$T_{RMSapprox}=T(j\lambda_1) \tag{21}$$

FIG. (14) shows the average torque plotted versus the approximated value of the R.M.S. Each point in the graph corresponds to a different operating point for the engine, with speed varying from 1000 to 5000 RPM. A relationship that is interesting is found to be strictly linear at each operating point, and the best-fitted line obtained with the least squares method is shown in Eq. (22) below, $$T_{average}=m\cdot T_{RMSapprox}+b \tag{22}$$

where m=0.5854 and b=−34.377. This result allows a very important consideration, which is an estimate of both fluctuating and average torque components can be obtained from crankshaft speed fluctuations only. Also, FIG. (15) shows an example of the results obtained from the engine and dynamometer setup at a certain operating condition during the experiments.

Real-Time Torque Estimation

The methodology behind the real-time torque estimation is presented with the simulation results. Then, the experimental results of the real-time estimation on the current engine and dynamometer set up are provided as well. The stochastic estimation approach described previously was implemented in real-time.

Coefficient Estimation—The cross-correlation functions as well as the coefficient set in the basis functions were constructed for each specific cases as well as each engine operating condition. In other words, the coefficient set for each basis function is valid for one specific case and operating condition for which they are evaluated. However, in an actual engine operation, these conditions (engine speed and load) are continuously changing. To be able to implement the stochastic estimation technique in a real-time basis, the indicated torque is estimated accurately over a wide range of the engine operating conditions such as speed and load. The pre-computed coefficient set of the selected basis function may be stored as a mapping format so that the indicated torque may be estimated based on this pre-stored coefficient map at each instance of the engine operation. In another approach, each of the basis function coefficients themselves is estimated as another function of the engine operating conditions such as speed, load, or spark advance.

In order to achieve the coefficient estimation technique properly while eliminating the need for a coefficient mapping, another set of estimation functions may be established that relate each of the coefficients in a basis function to the engine operating conditions. Table (6) describes this set of estimation functions, which may be specifically used to estimate the basis function coefficients. Note that these estimation functions will be referred as "Sub-Basis Functions." In Table (6), 'rpm' represents the mean engine speed in RPM, 'Itq' represents the mean engine load, expressed as the intake manifold pressure in kPa, and '$\theta_s$' represents the spark advance timing in crank angle degree.

TABLE 6

Various Sub-Basis Functions

| Function Number | Sub-Basis Function |
|---|---|
| 1 | $a_i = b_{0,i} + b_{1,i} \cdot rpm + b_{2,i} \cdot Itq$ |
| 2 | $a_i = b_{0,i} + b_{1,i} \cdot rpm + b_{2,i} \cdot Itq + b_{3,i} \cdot rpm \cdot Itq$ |
| 3 | $a_i = b_{0,i} + b_{1,i} \cdot rpm + b_{2,i} \cdot Itq + b_{3,i} \cdot rpm^2 + b_{4,i} \cdot Itq^2$ |
| 4 | $a_i = b_{0,i} + b_{1,i} \cdot rpm + b_{2,i} \cdot Itq + b_{3,i} \cdot rpm \cdot Itq + b_{4,i} \cdot rpm^2 + b_{5,i} \cdot Itq^2$ |
| 5 | $a_i = b_{0,i} + b_{1,i} \cdot rpm + b_{2,i} \cdot Itq + b_{3,i} \cdot rpm \cdot Itq + b_{4,i} \cdot rpm^2 + b_{5,i} \cdot Itq^2 + b_{6,i} \cdot rpm^2 \cdot Itq^2$ |
| 6 | $a_i = b_{0,i} + b_{1,i} \cdot rpm + b_{2,i} \cdot Itq + b_{3,i} \cdot rpm \cdot Itq + b_{4,i} \cdot rpm^2 + b_{5,i} \cdot Itq^2 + b_{6,i} \cdot rpm^2 \cdot Itq + b_{7,i} \cdot rpm \cdot Itq^2 + b_{8,i} \cdot rpm^2 \cdot Itq^2$ |
| 7 | $a_i = b_{0,i} + b_{1,i} \cdot rpm + b_{2,i} \cdot Itq + b_{3,i} \cdot \theta_s$ |
| 8 | $a_i = b_{0,i} + b_{1,i} \cdot rpm + b_{2,i} \cdot Itq + b_{3,i} \cdot \theta_s + b_{4,i} \cdot rpm \cdot \theta_s + b_{5,i} \cdot Itq \cdot \theta_s$ |
| 9 | $a_i = b_{0,i} + b_{1,i} \cdot rpm + b_{2,i} \cdot Itq + b_{3,i} \cdot \theta_s + b_{4,i} \cdot rpm \cdot \theta_s + b_{5,i} \cdot Itq \cdot \theta_s + b_{6,i} \cdot \theta_s^2 + b_{7,i} \cdot rpm \cdot \theta_s^2 + b_{8,i} \cdot Itq^2 \cdot \theta_s^2$ |

The coefficients $b_i$ shown in Table (6) may be determined by minimizing the root mean square error between the trained coefficients and the estimated coefficients as shown in Eq. (23) below.

$$\varepsilon = \min_{b_{ji}}\left(\sum_{i=1}^{N}(a_{trained,i} - a_{estimated,i})^2\right) \tag{23}$$

Then, another set of the cross-correlation matrix system, similar to Eq. (10), may be constructed to determine the coefficient set $b_i$'s. As indicated by the seven basis functions shown in Table (5) combined with the nine sub-basis functions shown in Table (6) for both 36 and 60 resolutions, the coefficient set may actually be expressed as a function of the engine mean speed, mean load, and spark advance using any of the sub-basis functions described in Table (6). FIG. (16) provides an example where the coefficients of basis function 3 are estimated using the sub-basis function 2. Note that the coefficient shown in this figure is $a_1$ in the basis function 3.

Referring to FIG. (16), the first sub-figure represents effectively the changes in the coefficient $a_1$ as a function of mean engine speed and load whereas the second sub-figure is simply connecting the lines of the first figure in the order of increasing speed and load (from left to right in x-axis). Referring to FIG. (16), the trained coefficient $a_1$ shows a quasi-linear relationship with the engine speed and load, and as a result, the sub-basis function ($1^{st}$ order linear) is able to produce the estimated coefficient with a very good accuracy.

This kind of quasi-linear characteristics of the coefficient with the engine operating conditions may be found in those coefficients of linear terms in basis functions. In other words, coefficients in the non-linear terms, such as the cross-terms in basis functions, typically do not have this type of convenient quasi-linear characteristic with respect to the engine operating conditions. To overcome this problem, other sub-basis functions with more complex non-linear terms shown in Table (6) may be used for the coefficient estimation.

Indicated Torque Estimation

Simulation In Real-Time—In order to simulate the torque estimation in real-time, Simulink™ was used to carry out the simulation tasks on the actual engine experimental data set described previously. FIGS. (17) and (18) represent some of the results acquired from the simulation of real-time torque estimation. In this example, the estimation was carried out based on the choice of basis function 8, sub-basis function 6, and 36 resolutions at 2000 RPM and 30 $lb_f$-ft. The other cases of the basis and sub-basis functions, number of resolutions, and engine operating conditions were also investigated using the same approach. FIG. (19) shows an example of R.M.S. errors resulted from the estimation of indicated torque at each individual cylinder based on 36 resolutions for all basis and sub-basis functions, averaged over all engine operating conditions. In the FIG. (19), the bold straight line represents the variation of R.M.S. errors for which the trained (exact) coefficients were used.

As it can be observed in FIGS. (17–19), even with the estimated coefficient sets the indicated torque estimation for both individual cylinders and summation of all cylinders provide accurate results within an acceptable tolerance. Particularly in FIG. (19), it may be easily noticed that R.M.S. errors of the real-time torque estimation suddenly increase for the basis functions 5 through 7 while they tend to reduce for those basis functions when the trained coefficient are used. This result is due to the fact that a higher number of basis function consists of more complex $2^{nd}$ order non-linear terms inside the equation, which eventually makes the coefficients to become highly non-linear with respect to the engine operating conditions. As a result of that, the estimated coefficients become less accurate, which then leads the higher value of R.M.S. errors for basis functions 5 to 7 as indicated in FIG. (19). For this reason, basis functions 1 through 4 were implemented in real-time for the further analysis of torque estimation during the actual engine operation.

Estimation During Actual Engine Operation—In order to achieve the real-time estimation properly, the dSPACE AUTOBOX system (DS1003) was used for carrying out the necessary computational tasks in real-time during the actual engine operation. All the results shown are based on 36 resolutions of measurements per crankshaft rotation using the basis function 3 and sub-basis function 2 (refer to Tables 5 and 6).

The estimation of indicated torque for each individual cylinder was first attempted applying the method of stochastic estimation. As described previously, coefficients of the torque estimation basis function were first estimated before performing the actual estimation of indicated torque. Then, applying these coefficients into the basis function at each instance of crankshaft position, speed fluctuation, and acceleration, the desired indicated torque was estimated. FIG. (20) provides an example of the individual cylinder indicated torque, estimated in real-time at 1000 RPM of speed and 10 $lb_f$-ft of load torque, and it is compared to the actual value of indicated torque shown in FIG. (21), which was acquired previously at the same engine operating condition.

Torque may be estimated successfully, even in real-time, using this type of estimation approach. The estimated torque has a good agreement with the actual value overall. This kind of over estimation around the peak value can be compensated by using other basis and sub-basis functions. Using the same basis and sub-basis functions as for the individual cylinder torque estimation, the summation of indicated torque produced by all four cylinders was also estimated directly. FIG. (22) shows an example of torque summation, estimated in real-time while the engine was running at 1500 RPM of speed and 30 $lb_f$-ft of load torque. Then, FIG. (23) provides a comparison with the actual indicated torque, which was acquired previously at the same engine operating condition. Again, the two figures indicate that sum of indicated torque for all cylinders can be accurately estimated as well as individual cylinder torque. Relatively simple estimation models, such as basis function 3 and sub-basis function 2, still perform a reasonably accurate estimation while keeping the computational requirements minimal during the real-time operation.

Using the present invention, the engine torque generated by each cylinder in an IC engine can be successfully estimated based on the crankshaft angular position and speed measurements. The Stochastic Analysis and Frequency Analysis techniques cover a wide range of operating conditions. Moreover, the torque estimation system and method are independent of the engine inputs (Air, Fuel, and Spark). The procedure allows estimation of not only the cycle-averaged indicated torque but also the indicated torque based on the crank-angle resolution with small estimation errors. Furthermore, the procedures show the capability of performing torque estimations based on a low sampling resolution, thus reducing the computational requirements, which lends itself to the real-time on-board estimation and control. In summary, the approaches may be applied for the event-based control in real-time, while eliminating the need for in-cylinder pressure transducers. As a result, it is possible to develop practically implementable engine diagnostics and control developments providing the individual cylinder combustion control, transmission shift control, cylinder deactivation control, which would lead to reduced emissions and lower fuel consumptions.

The following references, in their entirety, are incorporated herein by reference.

1. Y. Guezennec and P. Gyan, "A Novel Approach to Real-Time Estimation of the Individual Cylinder Combustion Pressure for S. I. Engine Control," SAE Technical Paper 1999-01-0209.
2. D. Lee and G. Rizzoni, "Detection of Partial Misfire in IC Engines Using a Measurement of Crankshaft."
3. G. Rizzoni, "Estimate of Indicated Torque from Crankshaft Speed Fluctuations: A Model for the Dynamics of IC Engine," *IEEE Transactions on Vehicular Technology*, Vol. VT-38, No. 3, pp. 168–179.
4. G. Rizzoni, "A Dynamic Model for the Internal Combustion Engine," Ph.D. Dissertation, University of Michigan, Ann Arbor, Mich., 1986.
5. K. Srinivasan, G. Rizzoni, V. Trigui, and G. C. Luh, "On-line Estimation of Net Engine Torque from Crankshaft Angular Velocity Measurement Using Repetitive Estimations," *Proceedings of the American Control Conference*, pp. 516–520, 1992.
6. S. Drakunov, G. Rizzoni, and Y. Y. Wang, "Estimation of Engine Torque Using Nonlinear Observers in the Crank Angle Domain," *Proc. 5th ASME Symposium on Advanced Automotive Technologies*, ASME IMECE, San Francisco, Calif., November 1995.
7. M. Kao and J. Moskwa, "Nonlinear Turbo-Charged Diesel Engine Control and State Observation," ASME Winter Annual Meeting, New Orleans, La., pp. 187–198, 1993.
8. G. Rizzoni, Y. W. Kim, Y. Y. Wang, "Design of An IC Engine Torque Estimator Using Unknown Input Observer," *ASME Journal of Dynamic Systems, Measurement, and Control*, Vol. 121, pp. 487–495, 1999.
9. P. C. Mueller and M. Hou, "Design of Observers for Linear Systems for Unknown Inputs," *IEEE transactions on Automatic Control*, Vol. AC-37, No. 6, pp. 871–874, 1992.
10. V. L. Symos, "Computational Observer Design Techniques for Linear System with Unknown Inputs Using the Concept of Transmission Zeros," *IEEE transactions on Automatic Control*, Vol. AC-38, pp. 790–794, 1993.
11. P. Gyan, S. Ginoux, J. C. Champoussin, Y. Guezennec, "Crankangle Based Torque Estimation: Mechanistic/Stochastic," SAE Technical Paper 2000-01-0559.
12. J. Heywood, Internal Combustion Engine Fundamentals, McGraw-Hill, New York, 1988.

What is claimed is:

1. A method for estimating indicated torque in an internal combustion engine based on at least one crankshaft dynamic variable comprising:

estimating in-cylinder combustion pressure according to a stochastic estimation method that uses a statistical correlation function in the time domain to express said in-cylinder combustion pressure as a polynomial function of a measurement of said at least one crankshaft dynamic variable; and calculating indicated torque using said internal combustion engine, crank-slider mechanism geometry, and said estimated in-cylinder combustion pressure.

2. The method of claim 1 wherein said crankshaft dynamic variable is selected from the group consisting of crankshaft position, crankshaft velocity, and crankshaft acceleration.

3. The method of claim 1 wherein said polynomial function for estimating in-cylinder combustion pressure is based on 36, 60, or 360 measurements of said at least one crankshaft dynamic variable per one revolution of the crankshaft.

4. The method of claim 1 wherein said polynomial function comprises coefficients expressed as a polynomial function of said internal combustion engine operating conditions.

5. The method of claim 4 wherein said of said internal combustion engine operating conditions comprise engine speed and engine load.

6. The method of claim 5 wherein said engine speed is represented as the average rotational engine speed averaged over one complete engine cycle.

7. The method of claim 5 wherein said engine load is represented as the average intake manifold absolute pressure averaged over one complete engine cycle.

8. A method for estimating indicated torque in an internal combustion engine based on at least one crankshaft dynamic variable comprising:

estimating coefficients of a polynomial function for estimating an in-cylinder combustion pressure using measurements of average engine speed and intake manifold pressure:

estimating said in-cylinder combustion pressure using said estimated coefficients and measurements of said at least one crankshaft dynamic variable; and calculating indicated torque using said internal combustion engine, crank-slider mechanism geometry, and said estimated in-cylinder combustion pressure.

9. The method of claim 8 wherein said crankshaft dynamic variable is selected from the group consisting of crankshaft position, crankshaft velocity, and crankshaft acceleration.

10. The method of claim 8 wherein said polynomial function for estimating in-cylinder combustion pressure is based on 36, 60, or 360 measurements of said at least one crankshaft dynamic variable per one revolution of the crankshaft.

11. A method for estimating indicated torque in an internal combustion engine comprising:

estimating in-cylinder combustion pressure according to a stochastic estimation method that uses a statistical correlation function in time domain to express said in-cylinder combustion pressure as a polynomial function of a crankshaft position function, crankshaft velocity, or crankshaft acceleration; and calculating indicated torque using said internal combustion engine, crank-slider mechanism geometry, and said estimated in-cylinder combustion pressure.

12. The method of claim 11 wherein said crankshaft position function is an algebraic function of the crankshaft position.

13. The method of claim 12 wherein said polynomial function for estimating in-cylinder combustion pressure is based on 36, 60, or 360 measurements of said crankshaft position, crankshaft velocity, or crankshaft acceleration per one revolution of the crankshaft.

14. The method of claim 11 wherein said polynomial function comprises coefficients expressed as a polynomial function of said internal combustion engine operating conditions using a stochastic estimation method.

15. The method of claim 14 wherein said of said internal combustion engine operating conditions comprise engine speed and engine load.

16. The method of claim 15 wherein said engine speed is represented as the average rotational engine speed averaged over one complete engine cycle.

17. The method of claim 15 wherein said engine load is represented as the average intake manifold absolute pressure averaged over one complete engine cycle.

18. A method for estimating indicated torque in an internal combustion engine comprising:

estimating coefficients of a polynomial function for estimating indicated torque using measurements of average engine speed and intake manifold pressure; and estimating indicated torque using said estimated coefficients and measurements of at least one crankshaft dynamic variable.

19. The method of claim 18 wherein estimating indicated torque using said estimated coefficients and measurements of at least one crankshaft dynamic variable comprises using 36, 60, or 360 measurements of said at least one crankshaft dynamic variable per revolution of the crankshaft.

20. The method of claim 19 wherein said at least one crankshaft dynamic variable is selected from the group consisting of crankshaft position, crankshaft velocity, and crankshaft acceleration.

21. A method for estimating indicated torque in an internal combustion engine based on a plurality of crankshaft dynamic variables comprising:

estimating in-cylinder combustion pressure according to a stochastic estimation method that uses a statistical correlation function in the time domain to express said in-cylinder combustion pressure as a polynomial function of a measurement of said plurality of crankshaft dynamic variables; and calculating indicated torque using said internal combustion engine, crank-slider mechanism geometry, and said estimated in-cylinder combustion pressure.

22. The method of claim 21 wherein said plurality of crankshaft dynamic variables are selected from the group consisting of crankshaft position, crankshaft velocity, and crankshaft acceleration.

* * * * *

UNITED STATES PATENT AND TRADEMARK OFFICE

CERTIFICATE OF CORRECTION

PATENT NO. : 6,866,024 B2
APPLICATION NO. : 10/092031
DATED : March 15, 2005
INVENTOR(S) : Rizzoni et al.

It is certified that error appears in the above-identified patent and that said Letters Patent is hereby corrected as shown below:

In column 4, lines 46-54,
please delete

“ $a_0\Sigma 1+a_1\Sigma x_{1,k}+a_2\Sigma x_{2,k}+a_3\Sigma x_{3,k}+a_4\Sigma x_{4,k}=\Sigma y_{true,k}$ $a_0\Sigma x_{1,k}+a_1\Sigma x_{1,k}{}^2+a_{2\Sigma x1,k}x_{2,k}a_3\Sigma x_{1,k}x_{3,k}a_4\Sigma x_{1,k}x_{4,k}=\Sigma x_{1,k}y_{true,k}$ $a_0\Sigma x_{2,k}+a_1\Sigma x_{1,k}x_{2,k}+a_2\Sigma x_{2,k}{}^2+a_3\Sigma x_{2,k}x_{3,k}+a_4\Sigma x_{2,k}x_{4,k}=\Sigma x_{2k}y_{true,k}$ $a_0\Sigma x_{3,k}+a_1\Sigma x_{1,k}x_{3,k}+a_2\Sigma x_{2,k}x_{3,k}+a_3\Sigma x_{3,k}{}^2a_4\Sigma x_{4,k}x_{3,k}=\Sigma x_{3,k}y_{true,k}$ $a_0\Sigma x_{4,k}+a_1\Sigma x_{1,k}x_{4,k}+a_2\Sigma x_{2,k}x_{4,k}+a_3\Sigma x_{3,k}x_{4,k}+a_4\Sigma x_{4,k}{}^2=\Sigma x_{4,k}y_{true,k}$ ”

and insert $$a_0\Sigma 1+a_1\Sigma x_{1,k}+a_2\Sigma x_{2,k}+a_3\Sigma x_{3,k}+a_4\Sigma x_{4,k}=\Sigma y_{true,k}$$
$$a_0\Sigma x_{1,k}+a_1\Sigma x_{1,k}^2+a_2\Sigma x_{1,k}x_{2,k}+a_3\Sigma x_{1,k}x_{3,k}+a_4\Sigma x_{1,k}x_{4,k}=\Sigma x_{1,k}y_{true,k}$$
-- $$a_0\Sigma x_{2,k}+a_1\Sigma x_{1,k}x_{2,k}+a_2\Sigma x_{2,k}^2+a_3\Sigma x_{2,k}x_{3,k}+a_4\Sigma x_{2,k}x_{4,k}=\Sigma x_{2,k}y_{true,k}$$ --.
$$a_0\Sigma x_{3,k}+a_1\Sigma x_{1,k}x_{3,k}+a_2\Sigma x_{2,k}x_{3,k}+a_3\Sigma x_{3,k}^2+a_4\Sigma x_{4,k}x_{3,k}=\Sigma x_{3,k}y_{true,k}$$
$$a_0\Sigma x_{4,k}+a_1\Sigma x_{1,k}x_{4,k}+a_2\Sigma x_{2,k}x_{4,k}+a_3\Sigma x_{3,k}x_{4,k}+a_4\Sigma x_{4,k}^2=\Sigma x_{4,k}y_{true,k}$$

UNITED STATES PATENT AND TRADEMARK OFFICE

CERTIFICATE OF CORRECTION

PATENT NO. : 6,866,024 B2
APPLICATION NO. : 10/092031
DATED : March 15, 2005
INVENTOR(S) : Rizzoni et al.

It is certified that error appears in the above-identified patent and that said Letters Patent is hereby corrected as shown below:

In column 7, line 37,
please delete

" Estimated Value=$F(f_\theta, \theta\ddot{\theta}, \theta)$ (5) "

please insert -- $$Estimated\ Value = F\left(f_\theta, \tilde{\dot{\theta}}, \ddot{\theta}\right) \quad (5)$$ --.

In column 7, line 48,
please delete

" $P_{estimate}=a_0+a_1 f_\theta+a_2 f_\theta\theta\ddot{\theta}+a_3 f_\theta\theta\ddot{\theta}+a_4\theta\ddot{\theta}\theta$ (6) "

please insert -- $$P_{estimate} = a_0 + a_1 f_\theta + a_2 f_\theta \tilde{\dot{\theta}} + a_3 f_\theta \ddot{\theta} + a_4 \tilde{\dot{\theta}} \ddot{\theta} \quad (6)$$ --.

UNITED STATES PATENT AND TRADEMARK OFFICE

CERTIFICATE OF CORRECTION

PATENT NO. : 6,866,024 B2
APPLICATION NO. : 10/092031
DATED : March 15, 2005
INVENTOR(S) : Rizzoni et al.

It is certified that error appears in the above-identified patent and that said Letters Patent is hereby corrected as shown below:

In column 9, lines 40-61, please delete

"

TABLE 5

Various Basis Functions

| Function Number | Basis Function |
|---|---|
| 1 | $T_{estimate} = a_0 + a_1 f_\theta + a_2 \tilde{\dot{\theta}} + a_3 \ddot{\theta}$ |
| 2 | $T_{estimate} = a_0 + a_1 f_\theta + a_2 \tilde{\dot{\theta}} + a_3 \ddot{\theta} + a_4 \tilde{\dot{\theta}}^2$ |
| 3 | $T_{estimate} = a_0 + a_1 f_\theta + a_2 f_\theta \tilde{\dot{\theta}} + a_3 f_\theta \ddot{\theta} + a_4 \tilde{\dot{\theta}} \ddot{\theta}$ |
| 4 | $T_{estimate} = a_0 + a_1 f_\theta + a_2 f_\theta \tilde{\dot{\theta}} + a_3 f_\theta \ddot{\theta} + a_4 f_\theta \tilde{\dot{\theta}} + a_5 f_\theta \ddot{\theta} + a_6 \tilde{\dot{\theta}} \ddot{\theta}$ |
| 5 | $T_{estimate} = a_0 + a_1 f_\theta + a_2 \tilde{\dot{\theta}} + a_3 \ddot{\theta} + a_4 f_\theta^2 + a_5 f_\theta \tilde{\dot{\theta}}^2 + a_6 \ddot{\theta}^2$ |
| 6 | $T_{estimate} = a_0 + a_1 f_\theta + a_2 f_\theta \tilde{\dot{\theta}} + a_3 f_\theta \ddot{\theta} + a_4 \tilde{\dot{\theta}}^2 + a_5 \tilde{\dot{\theta}} \ddot{\theta} + a_6 \ddot{\theta}^2$ |
| 7 | $T_{estimate} = a_0 + a_1 f_\theta + a_2 \tilde{\dot{\theta}} + a_3 \ddot{\theta} + a_4 f_\theta^2 + a_5 f_\theta \tilde{\dot{\theta}} + a_6 f_\theta \ddot{\theta} + a_7 \tilde{\dot{\theta}}^2 + a_8 \tilde{\dot{\theta}} \ddot{\theta} + a_9 \ddot{\theta}^2$ |

"

please insert -- Table 5. Various Basis Functions

| Function Number | Basis Function |
|---|---|
| 1 | $T_{estimate} = a_0 + a_1 f_\theta + a_2 \tilde{\dot{\theta}} + a_3 \ddot{\theta}$ |
| 2 | $T_{estimate} = a_0 + a_1 f_\theta + a_2 \tilde{\dot{\theta}} + a_3 \ddot{\theta} + a_4 \tilde{\dot{\theta}}^2$ |
| 3 | $T_{estimate} = a_0 + a_1 f_\theta + a_2 f_\theta \tilde{\dot{\theta}} + a_3 f_\theta \ddot{\theta} + a_4 \tilde{\dot{\theta}} \ddot{\theta}$ |
| 4 | $T_{estimate} = a_0 + a_1 f_\theta + a_2 \tilde{\dot{\theta}} + a_3 \ddot{\theta} + a_4 f_\theta \tilde{\dot{\theta}} + a_5 f_\theta \ddot{\theta} + a_6 \tilde{\dot{\theta}} \ddot{\theta}$ |
| 5 | $T_{estimate} = a_0 + a_1 f_\theta + a_2 \tilde{\dot{\theta}} + a_3 \ddot{\theta} + a_4 f_\theta^2 + a_5 \tilde{\dot{\theta}}^2 + a_6 \ddot{\theta}^2$ |
| 6 | $T_{estimate} = a_0 + a_1 f_\theta + a_2 f_\theta \tilde{\dot{\theta}} + a_3 f_\theta \ddot{\theta} + a_4 \tilde{\dot{\theta}}^2 + a_5 \tilde{\dot{\theta}} \ddot{\theta} + a_6 \ddot{\theta}^2$ |
| 7 | $T_{estimate} = a_0 + a_1 f_\theta + a_2 \tilde{\dot{\theta}} + a_3 \ddot{\theta} + a_4 f_\theta^2 + a_5 f_\theta \tilde{\dot{\theta}} + a_6 f_\theta \ddot{\theta} + a_7 \tilde{\dot{\theta}}^2 + a_8 \tilde{\dot{\theta}} \ddot{\theta} + a_9 \ddot{\theta}^2$ |

--.

UNITED STATES PATENT AND TRADEMARK OFFICE

CERTIFICATE OF CORRECTION

PATENT NO. : 6,866,024 B2
APPLICATION NO. : 10/092031
DATED : March 15, 2005
INVENTOR(S) : Rizzoni et al.

It is certified that error appears in the above-identified patent and that said Letters Patent is hereby corrected as shown below:

In column 13, lines 26-44,
please delete

"

TABLE 6

Various Sub-Basis Functions

| Function Number | Sub-Basis Function |
|---|---|
| 1 | $a_i = b_{0,i} + b_{1,i} \cdot rpm + b_{2,i} \cdot ltq$ |
| 2 | $a_i = b_{0,i} + b_{1,i} \cdot rpm + b_{2,i} \cdot ltq + b_{3,i} \cdot rpm \cdot ltq$ |
| 3 | $a_i = b_{0,i} + b_{1,i} \cdot rpm + b_{2,i} \cdot ltq + b_{3,i} \cdot rpm^2 + b_{4,i} \cdot ltq^2$ |
| 4 | $a_i = b_{0,i} + b_{1,i} \cdot rpm + b_{2,i} \cdot ltq + b_{3,i} \cdot rpm \cdot ltq + b_{4,i} \cdot rpm^2 + b_{5,i} \cdot ltq^2$ |
| 5 | $a_i = b_{0,i} + b_{1,i} \cdot rpm + b_{2,i} \cdot ltq + b_{3,i} \cdot rpm \cdot ltq + b_{4,i} \cdot rpm^2 + b_{5,i} \cdot ltq^2 + b_{6,i} \cdot rpm^2 \cdot ltq^2$ |
| 6 | $a_i = b_{0,i} + b_{1,i} \cdot rpm + b_{2,i} \cdot ltq + b_{3,i} \cdot rpm \cdot ltq + b_{4,i} \cdot rpm^2 + b_{5,i} \cdot ltq^2 + b_{6,i} \cdot rpm^2 \cdot ltq + b_{7,i} \cdot rpm \cdot ltq^2 + b_{8,i} \cdot rpm^2 \cdot ltq^2$ |
| 7 | $a_i = b_{0,i} + b_{1,i} \cdot rpm + b_{2,i} \cdot ltq + b_{3,i} \cdot \theta_s$ |
| 8 | $a_i = b_{0,i} + b_{1,i} \cdot rpm + b_{2,i} \cdot ltq + b_{3,i} \cdot \theta_s + b_{4,i} \cdot rpm \cdot \theta_s + b_{5,i} \cdot ltq \cdot \theta_s$ |
| 9 | $a_i = b_{0,i} + b_{1,i} \cdot rpm + b_{2,i} \cdot ltq + b_{3,i} \cdot \theta_s + b_{4,i} \cdot rpm \cdot \theta_s + b_{5,i} \cdot ltq \cdot \theta_s + b_{6,i} \cdot \theta_s^2 + b_{7,i} \cdot rpm \cdot \theta_s^2 + b_{8,i} \cdot ltq^2 \cdot \theta_s^2$ |

"

and insert -- Table 6. Various Sub-Basis Functions

| Function Number | Sub-Basis Function |
|---|---|
| 1 | $a_i = b_{0,i} + b_{1,i} \cdot rpm + b_{2,i} \cdot ltq$ |
| 2 | $a_i = b_{0,i} + b_{1,i} \cdot rpm + b_{2,i} \cdot ltq + b_{3,i} \cdot rpm \cdot ltq$ |
| 3 | $a_i = b_{0,i} + b_{1,i} \cdot rpm + b_{2,i} \cdot ltq + b_{3,i} \cdot rpm^2 + b_{4,i} \cdot ltq^2$ |
| 4 | $a_i = b_{0,i} + b_{1,i} \cdot rpm + b_{2,i} \cdot ltq + b_{3,i} \cdot rpm \cdot ltq + b_{4,i} \cdot rpm^2 + b_{5,i} \cdot ltq^2$ |
| 5 | $a_i = b_{0,i} + b_{1,i} \cdot rpm + b_{2,i} \cdot ltq + b_{3,i} \cdot rpm \cdot ltq + b_{4,i} \cdot rpm^2 + b_{5,i} \cdot ltq^2 + b_{6,i} \cdot rpm^2 \cdot ltq^2$ |
| 6 | $a_i = b_{0,i} + b_{1,i} \cdot rpm + b_{2,i} \cdot ltq + b_{3,i} \cdot rpm \cdot ltq + b_{4,i} \cdot rpm^2 + b_{5,i} \cdot ltq^2 + b_{6,i} \cdot rpm^2 \cdot ltq + b_{7,i} \cdot rpm \cdot ltq^2 + b_{8,i} \cdot rpm^2 \cdot ltq^2$ |
| 7 | $a_i = b_{0,i} + b_{1,i} \cdot rpm + b_{2,i} \cdot ltq + b_{3,i} \cdot \theta_s$ |
| 8 | $a_i = b_{0,i} + b_{1,i} \cdot rpm + b_{2,i} \cdot ltq + b_{3,i} \cdot \theta_s + b_{4,i} \cdot rpm \cdot \theta_s + b_{5,i} \cdot ltq \cdot \theta_s$ |
| 9 | $a_i = b_{0,i} + b_{1,i} \cdot rpm + b_{2,i} \cdot ltq + b_{3,i} \cdot \theta_s + b_{4,i} \cdot rpm \cdot \theta_s + b_{5,i} \cdot ltq \cdot \theta_s + b_{6,i} \cdot \theta_s^2 + b_{7,i} \cdot rpm \cdot \theta_s^2 + b_{8,i} \cdot ltq^2 \cdot \theta_s^2$ |

--.

UNITED STATES PATENT AND TRADEMARK OFFICE

CERTIFICATE OF CORRECTION

PATENT NO. : 6,866,024 B2
APPLICATION NO. : 10/092031
DATED : March 15, 2005
INVENTOR(S) : Rizzoni et al.

It is certified that error appears in the above-identified patent and that said Letters Patent is hereby corrected as shown below:

In column 13, lines 51-53,
please delete

" $$\varepsilon = \min_{b_{ji}} \left( \sum_{i=1}^{N} (a_{trained,i} - a_{estimated,i})^2 \right) \quad (23)$$ "

please insert -- $$\varepsilon = \min_{b_{j,i}} \left( \sum_{i=1}^{N} \left(a_{trained,i} - a_{estimated,i}\right)^2 \right) \quad (23)$$ --.

Signed and Sealed this

Nineteenth Day of February, 2008

JON W. DUDAS
*Director of the United States Patent and Trademark Office*